US010584560B2

(12) United States Patent
Alley

(10) Patent No.: US 10,584,560 B2
(45) Date of Patent: Mar. 10, 2020

(54) DOWNHOLE ELECTRONIC TRIGGERING AND ACTUATION MECHANISM

(71) Applicant: WILDCAT OIL TOOLS, LLC, The Woodlands, TX (US)

(72) Inventor: Mark F. Alley, The Woodlands, TX (US)

( * ) Notice: Subject to any disclaimer, the term of this patent is extended or adjusted under 35 U.S.C. 154(b) by 0 days.

(21) Appl. No.: 16/522,619

(22) Filed: Jul. 25, 2019

(65) Prior Publication Data

US 2019/0360304 A1 Nov. 28, 2019

Related U.S. Application Data

(60) Provisional application No. 62/676,839, filed on May 25, 2018.

(51) Int. Cl.

| | |
|---|---|
| ***G06F 19/00*** | (2018.01) |
| ***E21B 34/10*** | (2006.01) |
| ***E21B 23/04*** | (2006.01) |
| ***E21B 47/06*** | (2012.01) |

(52) U.S. Cl.

CPC ..... *E21B 34/10* (2013.01); *E21B 23/04* (2013.01); *E21B 47/06* (2013.01)

(58) Field of Classification Search

CPC ..... E21B 34/10; E21B 23/04; E21B 47/06
See application file for complete search history.

(56) References Cited

U.S. PATENT DOCUMENTS

| | | | | |
|---|---|---|---|---|
| 5,769,163 | A * | 6/1998 | Meynier | E21B 23/04 166/206 |
| 2006/0207771 | A1* | 9/2006 | Rios, III | E21B 7/061 166/382 |
| 2009/0266536 | A1* | 10/2009 | Fox | E21B 43/128 166/250.01 |

(Continued)

OTHER PUBLICATIONS

Podio, A. L., Mccoy, J. N., Drake, B., & Woods, M. D. (Jul. 1, 1996). Decentralized Continuous-flow Gas Anchor. Petroleum Society of Canada. (Year: 1996).*

(Continued)

*Primary Examiner* — Michael D Masinick
(74) *Attorney, Agent, or Firm* — Hulsey P.C.

(57) ABSTRACT

A triggering mechanism for downhole equipment includes a housing for inserting downhole in an oilfield wellbore and associating downhole with a computer processor, a clock, at least one sensor circuit, and an electrical power source. The computer processor includes computer processing circuitry and a computer readable memory circuit. The sensor circuit senses at least a pressure parameter associated with the pressure within the oilfield wellbore downhole environment. A valve control circuit controls a valve and controls flow of control fluid to a hydromechanical device operating in association with the downhole tool within the oilfield wellbore. The valve control commands derive from real-time sampling of the downhole physical parameters to form ratio-based derivative values relating to physical parameter differences over a predetermined time span. In response to (Continued)

the ratio-based derivative values, the triggering mechanism generates triggering commands for flowing the control fluid to the associated hydromechanical device.

20 Claims, 16 Drawing Sheets

(56) References Cited

U.S. PATENT DOCUMENTS

2009/0301723 A1* 12/2009 Gray ..... E21B 23/00
166/301
2010/0307774 A1* 12/2010 Tinnen ..... E21B 23/06
166/387

OTHER PUBLICATIONS

Franco, E., Molero, N. J., Gerardo Romandia, M., Nevarez Carmona, C., Martinez-Ballesteros, A., Marin, E., & Perez Damas, J. del C. (Jan. 1, 2012). Enhancing the Effectiveness of Workover Interventions With Coiled Tubing and Real-Time Downhole Measurements. Society of Petroleum Engineers. (Year: 2012).*
Phillips, W. (Oct. 6, 2014). Testing of Hydraulic Tubing Anchors. Society of Petroleum Engineers. (Year: 2014).*

* cited by examiner

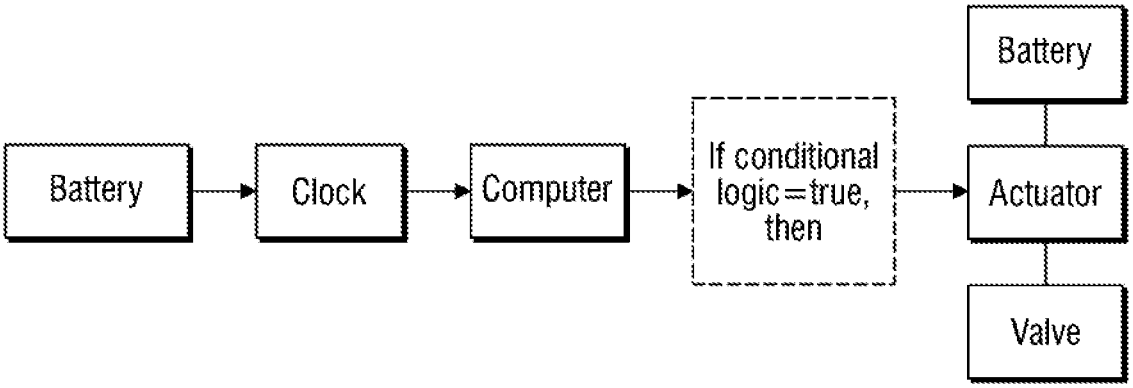

FIG. 1A

| | | | x = sqr root | y=sqr rt base X 2 | | z=sqr root base X 3 | | | | | | | |
|---|---|---|---|---|---|---|---|---|---|---|---|---|---|
| p time | cycle | pressure | x | y | z | | y/x | z/y | z/x | cycle | y2/x1 | z3/y2 | z3/x1 |
| 2 min | P1 | 1500 | 38.729833 | 77.45967 | 116.1895004 | | 2 | 1.5 | 3 | 1 | 2.19089 | | |
| 2 min | P2 | 1800 | 42.426407 | 84.85281 | 127.2792206 | | 2 | 1.5 | 3 | 2 | | 1.573213 | |
| 2 min | P3 | 1980 | 44.497191 | 88.99438 | 133.4915728 | | 2 | 1.5 | 3 | 3 | | | 3.446738 |
| | | | | | | | | | | | | | |
| | cycle | base p | x | y | z | | y/x | z/y | z/x | cycle | y2/x1 | z3/y2 | z3/x1 |
| 2 min | P1 | 3000 | 54.772256 | 109.5445 | 164.3167673 | | 2 | 1.5 | 3 | 1 | 2.19089 | | |
| 2 min | P2 | 3600 | 60 | 120 | 180 | | 2 | 1.5 | 3 | 2 | | 1.573213 | |
| 2 min | P3 | 3960 | 62.928531 | 125.8571 | 188.7855927 | | 2 | 1.5 | 3 | 3 | | | 3.446738 |

LOGIC: Ambient/hydrostatic pressure (e.g. slow change during trip) does not trigger. Pressure change must be fast as in algorithm.

Readings = 1 per second, rolling stack of readings

Applied pressures constant within 10 (adjust amplitude to expected pressure variation norms when pumping)

Pressure deployment lag +/- 20 seconds (adjust amplitude based on worst case/deepest case)

IF stable P1 runs clock 120 seconds +/- 20 seconds AND P2 at 120% of P1 runs clock 120 seconds +/- 20 seconds AND P3 at 110% of P2 clock 120 seconds +/- 20 seconds AND y2/x1 = 2.19 +/- 5% and z3/y2 = 1.57 +/- 5% and z3/x1 = 3.44 +/- 5%

THEN driver/controller/actuator causes valve to set the anchor

FIG. 1B

DOWNHOLE ELECTRONIC TRIGGERING AND ACTUATION MECHANISM

CROSS REFERENCE TO RELATED APPLICATIONS

This application claims the benefit of the following patent applications:

U.S. Provisional Patent Application 62/696,423 entitled "Dual-Action Hydraulically Operable Anchor," filed on Jul. 11, 2018 which is here expressly incorporated by reference;

U.S. Provisional Patent Application 62/696,750 entitled "Dual-Action Hydraulically Operable Anchor," filed on Jul. 11, 2018, which is here expressly incorporated by reference;

FIELD OF THE DISCLOSURE

The present disclosure relates generally to oilfield drilling and completion equipment and more particularly to downhole electronic triggering apparatus for use in harsh environments, such as downhole in a wellbore in the oil and gas industry, in conjunction with other electro-mechanical components requiring conditional actuation.

BACKGROUND OF THE DISCLOSURE

In the oil and gas industry, wellbores deviating from the vertical or perpendicular-to-the-surface plane to the horizontal plane have become increasingly common. Such horizontal or lateral wellbores are standard in hydrocarbon wells drilled into shale rock formations in the United States.

Many situations arise in complex lateral wells in which a conditional actuation of a downhole tool could be very beneficial, with whipstocks being a key example. When drilling a lateral well, it is necessary to place a whipstock in the wellbore so that a drilling bit may be directed out of the vertical plane and traverse into a horizontal—or relatively horizontal or lateral—plane. Anchoring systems, or "anchors," are common in the industry, serving to hold the whipstock in place, either temporarily or permanently. Typically, anchors are actuated either mechanically or hydraulically. A mechanical anchor is simpler in design and function, actuating when it meets an obstruction, such as a bridge plug. When force applied through the workstring from the surface, a plunger at the bottom of the mechanical anchor is depressed into the anchor as it is pushed against the obstruction. Internal mechanisms extend slip(s) lock the anchor in place, extending outward from the anchor as the plunger depresses into the anchor.

In many cases, however, a more complex, hydraulically actuated anchor, is required. Many wellbores do not have casing in place or bridge plugs set prior to needing to set a whipstock. With nothing to push against, a hydraulic anchor, well known in the art, is employed. A general weakness of hydraulic anchor systems lies in the hydromechanical valve system(s) that actuate these anchors. The hydromechanical valve system generally performs a dual function, both closing circulation to the annulus (establishing flow through the drill string) and sending fluid and pressure to actuate the hydraulic anchor. Currently, such valve systems are triggered by increasing flow and pressure through the wellbore until a circulation closing and anchor actuating device moves. Wellbore debris, erosion, and "Measurement While Drilling" (MWD)/directional systems can complicate the function of such valve systems. Reliability issues are common. In the prior art, problems persist with setting an anchor too soon, i.e. at a higher depth in the wellbore than the target depth. In such cases, the whipstock and anchor must be pulled from the wellbore through application of great pulling force from the rig at surface, or otherwise circumnavigated through sidetracking or drilling a new wellbore.

BRIEF SUMMARY OF THE DISCLOSURE

The present disclosure details a method, system, and fabrication method for a different, more reliable, more precise triggering and actuation mechanism that can consistently close off circulation to the annulus and set the anchoring device at the appropriate time and at the appropriate depth, generally after a device, e.g. MWD, has oriented the whipstock to the proper azimuth/direction. The disclosed apparatus does not use specific pressures to trigger a setting device, but rather uses ratios of pressure increases. The disclosed apparatus solves premature setting issues through electronic means, only triggering a setting mechanism after observed pressure ratios are analyzed and confirmed to match preprogrammed parameters. The disclosed apparatus solves issues that could result from unexpected pressure spikes in the wellbore pressure or from inadequate pump capacity to generate target pressures, as no specific target pressure is necessary and aberrant pressure events have no effect on the electronically executed process.

According to one aspect of the present disclosure, there is here provided a triggering mechanism for oilfield wellbore downhole equipment. The presently disclosed triggering mechanism includes a housing for inserting downhole in an oilfield wellbore and associating with a downhole tool in a predetermined and desired position within the oilfield wellbore. The housing further associates downhole with a computer processor, a clock, at least one sensor circuit, and an electrical power source.

The computer processor includes computer processing circuitry for processing executable instructions associated with a plurality of physical parameters within the oilfield wellbore. The computer processor further includes at least one computer memory circuit including a computer readable memory circuit for storing the executable instructions and data associated with the plurality of physical parameters. The clock provides timing data to the computer processor. The at least one sensor circuit senses the plurality of physical parameters within the oilfield wellbore and generates and communicates the data associated with the plurality of physical parameters. The plurality of physical parameters include at least a pressure parameter associated with the pressure within the oilfield wellbore downhole environment. The electrical power source includes circuitry for powering the computer processor downhole within the oilfield wellbore.

A valve control circuit receives a plurality of valve control commands from the computer processor for controlling a valve, wherein the valve control commands control a valve associated with a flow path flowing a control fluid. A valve operating in response to the valve control commands controls flow of the control fluid from the flow path to an associated hydromechanical device within the oilfield wellbore. The hydromechanical device operates in association with the downhole tool within the oilfield wellbore.

Here, the valve control commands derive from real-time sampling of the downhole physical parameters. In response to the real-time sampling of the downhole physical parameters, the computer processor generates a plurality of ratio-based derivative values relating to physical parameter differences over a predetermined time span within the downhole wellbore environment. In response to the plurality of ratio-based derivative values relating to the physical parameter differences the triggering mechanism generates triggering commands to the valve for flowing the control fluid to the associated hydromechanical device. The triggering commands actuate the associated hydromechanical device from a first condition or status to a second condition or status.

In another aspect of the present disclosure, here are disclosed methods, devices, and systems to provide a computer with a clock and one or more sensors and an electrical power source. In the instant, preferred embodiment, this apparatus includes a computer, clock, pressure transducer, and onboard power source such as a lithium battery or capacitor capable of operating independently in a downhole environment in a wellbore. In the preferred embodiment, the apparatus is capacitor powered and operating autonomously, not connected to any topside equipment. The apparatus is connected to a valve, with this valve, when actuated, being formed of any means of moving an impediment that restricts flow through a given channel to an open position or closed position that alters the flow path. A pump at the surface provides flow to the downhole apparatus. When the valve is actuated, the flow serves to actuate a separate hydromechanical system, such as a downhole anchor as part of a whipstock sidetracking system for horizontal drilling.

The apparatus uses a process that samples wellbore pressure continually, ideally sampling at least one pressure reading each second. The process contains logic that ignores slow changes in pressure, such as the lowering of the apparatus on drill pipe to a target depth. In other words, the gradual increase in ambient, hydrostatic pressure as the apparatus is lowered into the wellbore will not cause any triggering or unwanted actuation of a separate device. Similarly, an increase in pressure to make use of an MWD device, or intermittent pressure pulses generated by the MWD device, will not cause triggering. Additionally, an unexpected change in wellbore pressure, or even multiple pressure spikes, will not cause triggering, as pressure increases must match ratio values derived from pressures across a specific time horizon.

The process or program in the apparatus executes multiple ratio-based pressure derivative analyses. The values that are analyzed result from a surface pump operator pumps applying three pressures for corresponding time spans per simple instructions. When the ratio-based pressure values match preprogrammed parameters that include pressure, time and cross-checked ratios, then conditional logic yields a "true" result, which is to say a triggering event has occurred, and actuation of a separate device results. A technical advantage of the presently disclosed invention is increased reliability, with embodiments relying on few, or in some embodiments no, moving parts.

Another object of this disclosure is to provide not only hydromechanical, but some novel electromechanical and mechanical means of actuating a given downhole tool.

These and other objects of the present invention are achieved through a provision computer-driven, autonomous actuation of preprogrammed downhole valves and actuators.

Still further objects, technical aspects and advantages of the presently disclosed subject matter will become evident upon a full appreciation of the following specification, drawings, and claims.

BRIEF DESCRIPTION OF THE DRAWINGS

The present subject matter will now be described in detail with reference to the drawings, which are provided as illustrative examples of the subject matter so as to enable those skilled in the art to practice the subject matter. Notably, the FIGURES and examples are not meant to limit the scope of the present subject matter to a single embodiment, but other embodiments are possible by way of interchange of some or all of the described or illustrated elements and, further, wherein:

FIG. 1A depicts a graphical representation of the basic components and functional principle that applies to embodiments in the disclosed subject matter;

FIG. 1B shows sample calculation methodology for the process of the present disclosure;

DETAILED DESCRIPTION OF ILLUSTRATIVE EMBODIMENTS

Figure 1C:
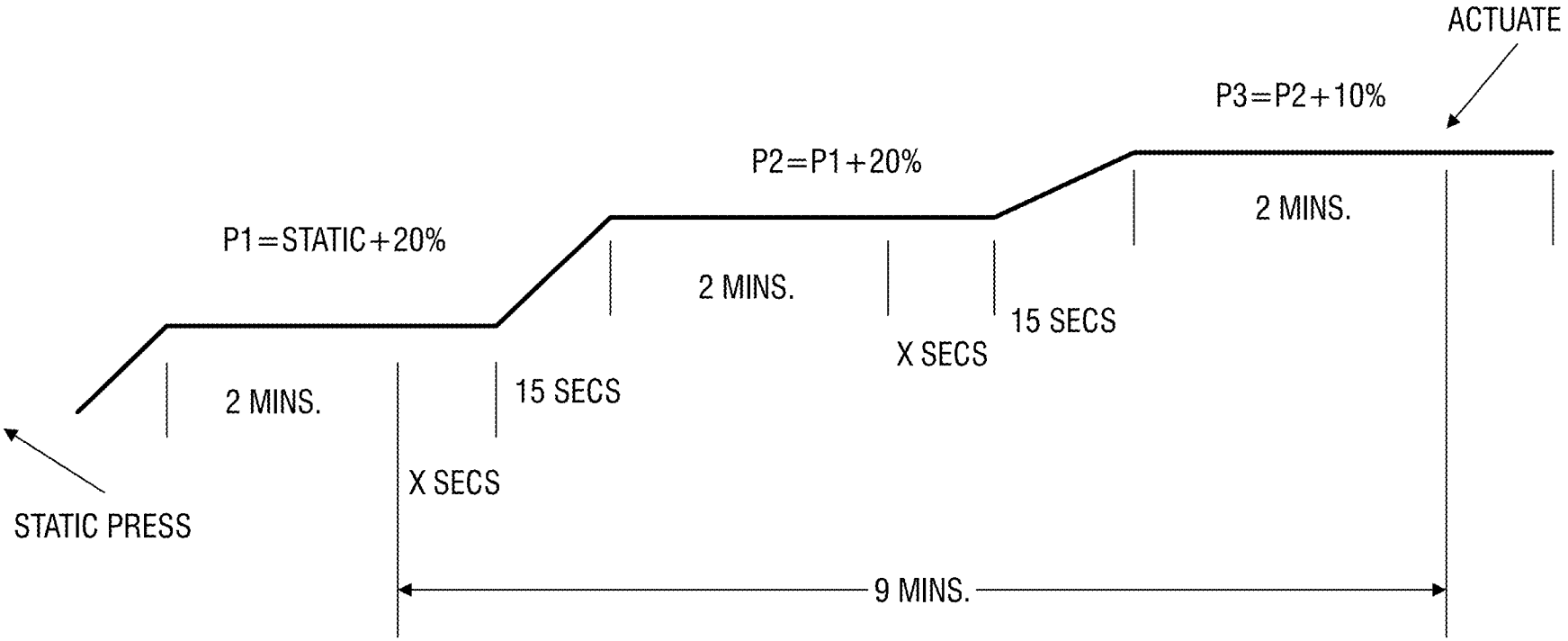
FIG. 1C depicts the process in action, with three pressure ratios applied from a surface pump and received at a transducer.

Various embodiments of the expandable anchor and methods of use will now be described with reference to the accompanying drawings, wherein like reference numerals are used for like features throughout the several views. The detailed description set forth below in connection with the appended drawings is intended as a description of exemplary embodiments in which the presently disclosed subject matter can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed subject matter may be practiced without these specific details. In some instances, well-known structures and devices are shown in functional or conceptual diagram form in order to avoid obscuring the concepts of the presently disclosed method and system.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", or "upstream" meaning toward the earth's surface or toward the entrance of a well bore; and with "down", "lower", or "downstream" meaning toward the bottom of the well bore. In the drawings, the cross-sectional side views of the expandable anchor should be viewed from top to bottom, with the upstream end at the top of the drawing and the downstream end at the bottom of the drawing.

In the present specification, an embodiment showing a singular component should not be considered limiting. Rather, the subject matter preferably encompasses other embodiments including a plurality of the same component, and vice-versa, unless explicitly stated otherwise herein. Moreover, the applicant does not intend for any term in the specification or claims to be ascribed an uncommon or special meaning unless explicitly set forth as such. Further, the present subject matter encompasses present and future known equivalents to the known components referred to herein by way of illustration.

One or more embodiments of the disclosure are described below. It should be noted that these and any other embodiments are exemplary and are intended to be illustrative of the disclosure rather than limiting. While the disclosure is widely applicable to different types of systems, it is impossible to include all the possible embodiments and contexts of the disclosure in this disclosure. Upon reading this disclosure, many alternative embodiments of the present disclosure will be apparent to the person's ordinary skill in the art.

The benefits and advantages that may be provided by the present disclosure has been described above with regard to specific embodiments. These benefits and advantages, and any elements or limitations that may cause them to occur or to become more pronounced are not to be construed as critical, required, or essential features of any of any or all of the claims. As used herein, the singular forms "a," "an," and "the" are intended to include the plural forms as well, unless the context clearly indicates otherwise. It is further understood that the terms "comprises" and/or "comprising" or "includes" and/or including", or any other variation thereof, are intended to be interpreted as nonexclusively including the elements or limitations which follow those terms. Accordingly, a system, method, or other embodiment that comprises a set of elements is not limited to only those elements, and may include other elements not expressly listed or inherent to the claimed embodiment. These terms when used in this specification, specify the presence of stated features, regions, integers, steps, operations, elements, and/or components, but do not preclude the presence or addition of one or more features, regions, integers, steps, operations, elements, components, and/or groups thereof.

FIG. 1A depicts a graphical representation of the basic components and functional principle that applies to embodiments in the disclosed subject matter. The program logic for the apparatus is based on square roots of ratios sampled over time. For illustrative purposes, an example of one such program logic is as follows:

A. The pressure transducer samples pressures once per second, with the pressures loaded into a rolling stack of pressures with 160 pressures stored in the stack and a new pressure being added and the oldest pressure being dropped each second. The stack of 160 pressures is used for actuation. A second rolling stack of 480 pressures, also sampled concurrently at one per second, is maintained to eliminate wellbore pressure from consideration as the base P1 pressure and also as a store of historical data for ratio calculation.

B. The computer analyzes the pressures and values derived from the pressures.

C. The pressures, and values derived from the pressures, are generated and analyzed as follows:

a. pressure 1 ("P1"), the base pressure applied from the surface pump operator,
   i. and value "X," the square root of P1;
   ii. value "Y," the square root of P1 multiplied by two;
   iii. value "Z," the square root of P1 multiplied by three.
b. pressure 2 ("P2"), a second pressure applied from the surface pump operator per supplied instructions,
   i. and value "X," the square root of P2;
   ii. value "Y," the square root of P2 multiplied by two;
   iii. value "Z," the square root of P2 multiplied by three.
c. pressure 3 ("P3"), a third pressure applied from the surface pump operator per supplied instructions,
   i. and value "X," the square root of P3;
   ii. value "Y," the square root of P3 multiplied by two;
   iii. value "Z," the square root of P3 multiplied by three.
d. The surface operator is instructed to provide as follows:
   i. P1: a base pressure, which may be virtually any pressure he chooses, but for illustrative purposes and by way of example, 1,500 psi to be pumped for two minutes. Due to pressure deployment lag, that is, the time needed to ramp up pressure, extra time may be added to the sample stack prior to, and subsequent to, the two-minute period. By way of example, sampling may occur over 120 seconds plus 20 seconds during ramping up to P1 and another 20 seconds subsequent to P1 while ramping up to P2. This method results in the 160 second rolling stack of pressures in A above.
   ii. P2: At the end of the two minutes for P1, the surface operator begins pumping at P2, P2 being P1 multiplied by 1.2, or a 20% increase from P1. P2 also continues for two minutes. Reiterating that due to pressure deployment lag, that is, the time needed to ramp up pressure, extra time may be added prior to, and subsequent to, the two-minute period. By way of example, sampling may occur over 120 seconds plus 20 seconds during ramping up to P2 and another 20 seconds subsequent to P2 while ramping up to P3. This method results in the 160 second rolling stack of pressures in A above.
   iii. P3: At the end of the two minutes for P2, the surface operator begins pumping at P3, P3 being P2 multiplied by 1.1, or a 10% increase from P2. P3 also continues for two minutes. As in d(i) and d(ii) above, allowance for pressure deployment lag results in extra time being added to the two-minute period and results in the 160 second rolling stack of pressures in A above.

e. P1, P2 and P3 as well as the values derived from them may be adjusted for variance due to the imprecise nature of oil and gas pumping operations and unpredictable downhole conditions. By way of example, if 90 of 120 samples occur within +/−5% of a consistent range during P2 pumping, the samples will reach the validity threshold during the P2 pumping period to initiate evaluation of P3 and all values derived from pressures.

f. A secondary cross check of values and secondary opportunity for adjustments for variance is provided through ratio analysis:
   i. Y from P2 is divided by X from P1, and the result, given the exemplary values should be 2.19, with allowances for variance or other adjustment as deemed necessary. This ratio does not change with different P1, P2 and P3 values as long as the instructed pumping ratios are followed.
   ii. Z from P3 is divided by Y from P2, and the result, given the exemplary values should be 1.57, with allowances for variance or other adjustment as deemed necessary. This ratio does not change with different P1, P2 and P3 values as long as the instructed pumping ratios are followed.
   iii. Z from P3 is divided by X from P1, and the result, given the exemplary values should be 3.45, with allowances for variance or other adjustment as deemed necessary. This ratio does not change with different P1, P2 and P3 values as long as the instructed pumping ratios are followed.

g. When pressures and derived ratio values, as listed above in C(a-f) above, match preprogrammed parameters, then conditions are deemed to be met and a subsequent action occurs. In Boolean logic, conditional variables or an "if" condition is true when pressures and derived ratio values in C(a-f) match preprogrammed parameters and then a consequent action is executed. In the preferred embodiment, the consequent action is a signal to actuate a downhole valve.

Additional program modifiers may be incorporated, such as heuristic or machine learning process that can potentially simplify the triggering process over time, making it simpler for the pump operator at the surface by learning to understand when a triggering event should occur.

Entirely different programs may be used, such as process that utilize stepped decreasing pressure ranges, or alternating decreasing and increasing pressures.

Depth, directional (through MEMS gyroscopes and accelerometers), and temperature sensors and resulting process modifiers may be incorporated in additional embodiments to be utilized in addition to or in place of the pressure trigger method described above.

Each of the disclosed embodiments includes a process based on pressure ratios as described above. In this disclosure, the term "capacitor" may be used interchangeably with any sub-type of capacitor, e.g. "supercapacitor" or "ultracapacitor." A battery, such as a lithium battery, may be used in place of capacitors in every instance.

FIG. 1A depicts a graphical representation of the basic components and functional principle that applies to embodiments in this disclosure.

FIG. 1B shows sample calculation methodology for the process that is applied in embodiments in this disclosure, utilizing pressure ratios to instruct a downhole actuator as to whether it should actuate or remain inactive.

Figure 2A:
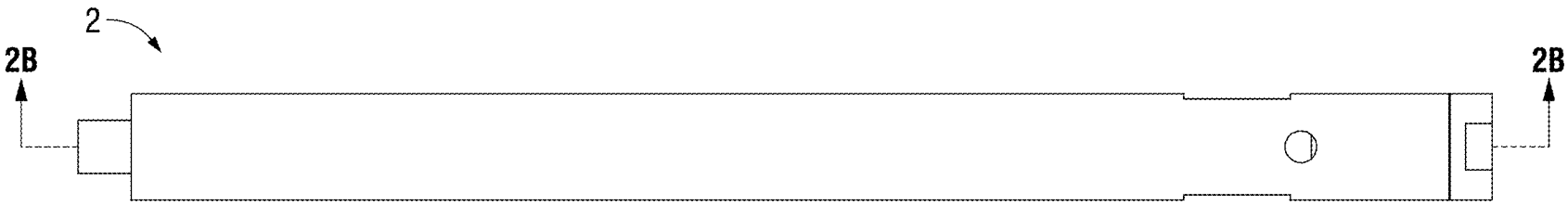
FIG. 2A depicts the exterior of an actuator in isometric view bisecting the actuator axial center.
Figure 2B:
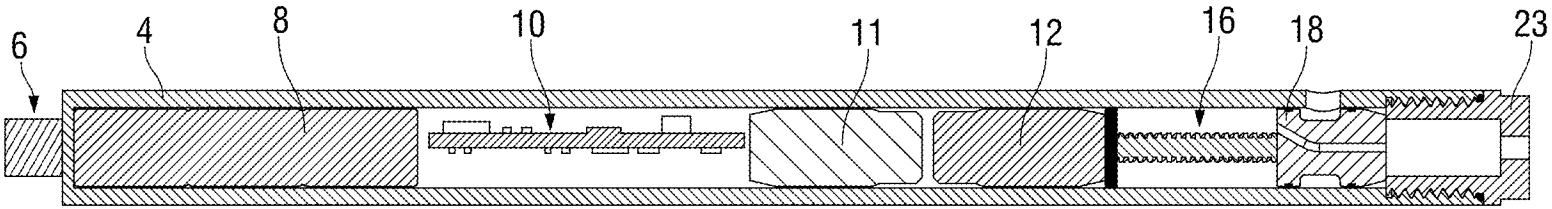
FIG. 2B depicts a section view an actuator showing screw-operated of spool valve actuation.
Figure 2C:
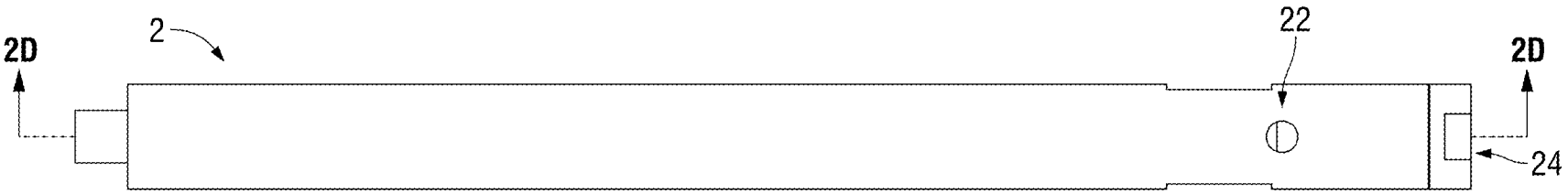
FIG. 2C depicts the exterior the actuator of the present disclosure in isometric view.
Figure 2D:
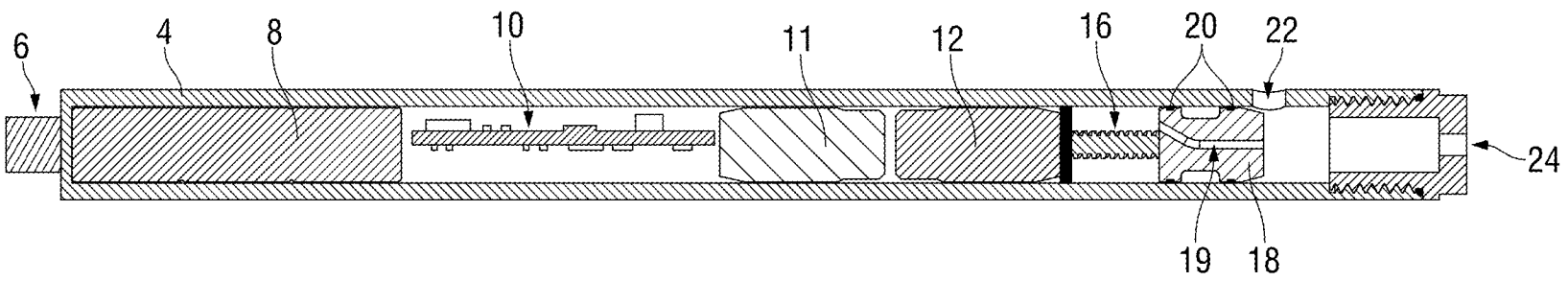
FIG. 2D depicts a section view of the presently disclosed actuator

FIG. 1C depicts the process in action, with three pressure ratios applied from a surface pump and received at a transducer such as the transducer in FIG. 2B and FIG. 2D. The graphical representation in FIG. 1C indicates that after analysis of three applied pressures over three time periods, actuation of an associated device is triggered. This process, in the form depicted in FIG. 1C or a very similar process adjusted for given time and pressure variables at a well, is used in all embodiments in this disclosure.

In one embodiment, a spool inside a tube has external circumferentially-disposed seals on each end of the spool that seat against the tube wall, sealing the spool against the tube wall. The tube has a hole or plurality of holes in a circumferential, radial area, with such holes being positioned between the seals of the spool located inside the tube. A pressure transducer is affixed to one end of the tube, with capacitors, computer, and electric motor inside the tube and proximal to the transducer, with the computer communicating with the transducer. A hole is located at the other end of the tube distal from the transducer. A screw, preferably an acme threaded screw with nut, is attached to the electric motor, with the electric motor having the capability of turning the screw when receiving a signal from the computer, with the computer sending the signal after analyzing pressures sent to it via the transducer. The spool inside the tube is connected to the screw, and can move either distally from the transducer end or proximally to the transducer end when the screw turns, depending on the direction of rotation of the screw. External pressure is blocked by the spool while it remains in its initial position. When the spool moves in either direction, and a seal at one end of the spool moves beyond the hole(s) located circumferentially in the tube around the middle of the spool, external pressure and fluid can enter the tube. If the spool is retracted toward the transducer end, fluid will enter the tube through the holes in the side of the tube and exit through the end of the tube. The spool may have an axial bore through its center, equalizing the pressure between the tube's end with the transducer and the end with the hole, making movement of the spool easier.

FIG. 2A depicts the exterior of actuator 2 in isometric view, showing where section 2B-2B, bisecting the axial center of actuator 2, is taken from. FIG. 2B depicts a section view 2B-2B of an actuator 2 that enables screw-operated actuation of a spool valve. The spool 18 is shown in its first position, a position that prevents external pressurized flow from entering the device. FIG. 2B further includes the housing 4, made of a material capable of resisting burst or crush pressure, a pressure transducer 6, capacitor(s) 8, a computer 10, an electric motor 12, lead screw 16, a spool 18 made of a hard and pressure resistant material, O-rings 20 for sealing between spool 18 and housing 4. A side hole 22 is shown bored transverse to the middle portion of the spool 18. The middle portion of the spool 18 is exposed to external pressure, but O-rings 20 seal the cavity containing the lead screw 16 and also the cavity toward end hole 24, an orifice in end connection 23. The lead screw 16 has threads that match threads in a bore in the spool 18. For ease of spool movement under equalized pressure conditions in the cavity containing the lead screw 16 and cavity adjacent to end hole 24, a spool throughbore 19 is bored completely through spool 18. Upon the receipt of the required pressure ratios at the pressure transducer 6 and analysis of these ratios by computer 10, the computer 10 causes the capacitor to send current to the electric motor 12, causing the electric motor 12 to begin rotating the lead screw 16 and moving the spool 18 either axially away or toward the electric motor 12, depending upon programming in the computer 10.

FIG. 2C depicts the exterior of actuator 2 in isometric view, showing where section 2D-2D, bisecting the axial center of actuator 2, is taken from.

FIG. 2D depicts a section view 2D-2D showing the second position of the spool valve with screw-operated actuation having occurred and the spool 18 having moved in the direction of the electric motor 12. This second position permits external flow to enter the device due to external pressure being greater than internal pressure inside the housing 4. Specifically, movement of the O-rings 20 out of the pressurized flow-preventing second position shown in FIG. 2D and into this second position allows flow to enter side hole 22 and to exit end hole 24. End hole 24 is connected to a flow line for actuation of a separate device (not shown). FIG. 2D additionally includes the housing 4, made of a material capable of resisting burst or crush pressure, a pressure transducer 6, capacitor(s) 8, a computer 10, an electric motor 12, lead screw 16, a spool 18 made of a hard and pressure resistant material, O-rings 20 for sealing between spool 18 and housing 4. The lead screw 16 has threads that match threads in a central bore in the spool 18. In FIG. 2D, the receipt of the required pressure ratios at the pressure transducer 6 has already occurred and analysis of these ratios has been performed by computer 10, with the computer 10 having signaled the capacitor to send electric current to the electric motor 12, which has caused the electric motor 12 to rotate the lead screw 16 and move the spool 18 toward the electric motor 12. After actuation and the spool's 18 movement to the second position shown in FIG. 2D, external pressurized flow from the wellbore enters housing 4 through side hole(s) 22 and then passes through the spool throughbore 19 and through exit hole 24. Exit hole 24 is in hydraulic fluid communication with a separate downhole device, such as a hydraulic anchor (not shown).

In another embodiment, a stationary spool inside a tube has seals on each end of the spool that seat against the tube wall and the tube has a hole or plurality of holes in a circumferential, radial area, with such holes being positioned between the seals of the spool located inside the tube. A pressure transducer is affixed to one end of the tube, with capacitors, computer proximal to the transducer, with the computer communicating with the transducer, and with a hole bored in the opposite end of the apparatus, distal from the transducer end. However, in this embodiment, there is no motor or screw, and the spool remains stationary. A capacitor next to the computer has nichrome wire that runs through a sealed passageway inside the spool. The spool is either made of a non-conductive material or has portions contacting the nichrome wire inside the passageway insulated so as to prevent contact with any conductive parts of the spool.

A hole is bored transversely in the middle area of the spool between the two seals. To prevent external pressure from entering the spool, a meltable, frangible or dissolvable obstruction, such as a plug made of silver solder, is positioned inside the plug and blocks pressurized fluid flow from the external part of the spool to the internal part. Nichrome wire leads from the capacitor to the plug, contacting it and preferably enmeshed in it or intermingled with it. Upon receiving a signal from the computer, the capacitor sends current through the highly resistant nichrome wire, heating up it rapidly, and the plug melts, allowing fluid from outside the tube to enter the spool and pass through the hole at the end of the tube.

Figure 3A:
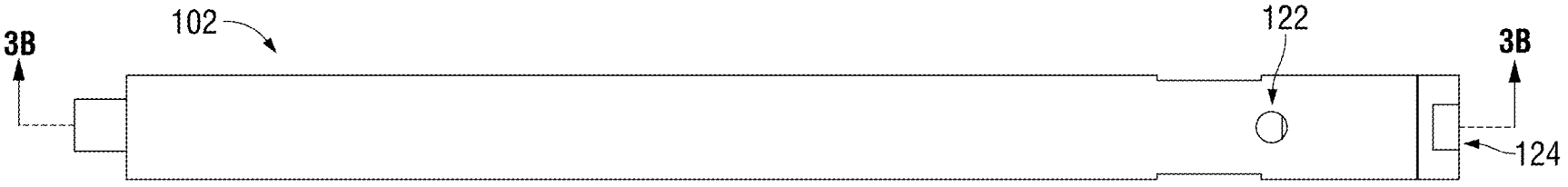
FIG. 3A depicts an electrically-powered actuator that enables fluid flow without the moving parts appearing elsewhere in the present disclosure.

FIG. 3A depicts an isometric view of electrically-powered actuator 100 that enables fluid flow without the moving parts of the embodiment shown in FIG. 2B and FIG. 2D.

Figure 3B:
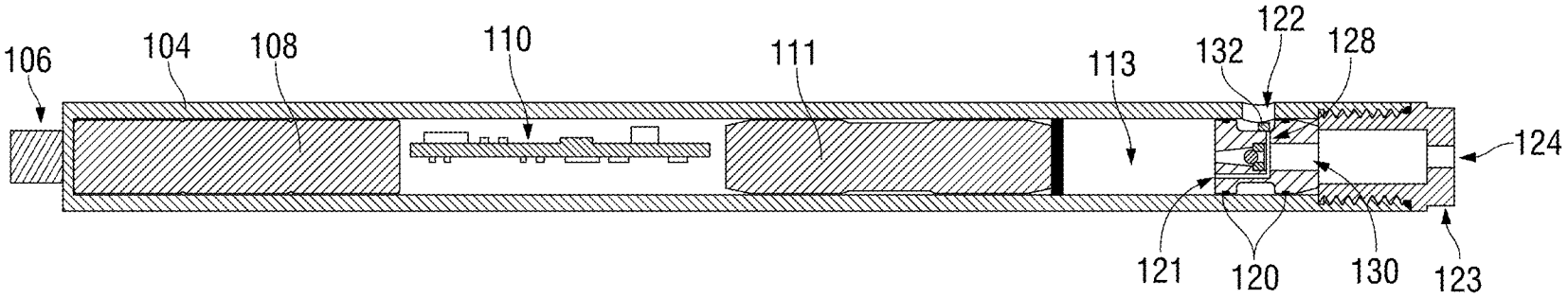
FIGS. 3B and 3C depict in detail an isometric and section view showing a check valve spool of the present disclosure.

FIG. 3B depicts section view 3B-3B of an actuator 100, housing 104, made of a material capable of resisting burst or crush pressure, a pressure transducer 106, capacitor(s) 108, a computer 110, a high voltage capacitor 111, a nichrome wire 113, a check valve spool 101 made of a hard and pressure resistant material, O-rings 120 for sealing between check valve spool 101 and housing 104. A side hole 122 is shown bored transverse to the middle portion of the check valve spool 101. The middle external circumference of the check valve spool 101 is exposed to external pressure, but O-rings 120 seal the cavity between high voltage capacitor 111 and check valve spool 101 and also the cavity between check valve spool 101 and end hole 124. A transverse bore 128 in the check valve spool 101 penetrates from the side of the spool to the axial center of check valve spool 101. End hole 124 is bored through end connection 123 which is threaded into the end of housing 104 distal from the high voltage capacitor 111. An axial bore 130 penetrates from the end of check valve spool 101 along the longitudinal center of check valve spool 101, terminating where it connects with transverse bore 128, forming a passageway. In the initial state, this passageway is blocked, as the transverse bore 128 is plugged with an obstruction 132, comprised of a meltable material, such as a solder with some content of silver. This prevents external pressurized flow from entering transverse bore 128 and axial bore 130. The nichrome wire 113 intersects and is enmeshed in the obstruction 132. The nichrome wire 113 has each of its two ends connected to the high voltage capacitor 111, with the looped end passing through sealed wire bore 121 and the looped portion being enmeshed in the obstruction 132. To avoid direct contact with the check valve spool 101, the nichrome wire 113 is insulated by ceramic material (not shown) between the check valve spool 101 and nichrome wire 113. Upon receipt of the required pressure ratios at the pressure transducer 106 and analysis of these ratios by computer 110, the computer 110 sends a signal to discharge the high voltage capacitor 111. When the high voltage capacitor 111 is discharged, the highly electrically resistant nichrome wire 113 rises rapidly in temperature such that the generated heat is sufficient to melt the obstruction 132. Without the obstruction, pressurized flow enters through axial bore 130, passes through transverse bore 128, and exits through end hole 124. End hole 124 and end connection 123 are connected to a hydraulic flow line for actuation of a separate device (not shown), such as an anchor, packer, or other similar downhole tool.

Figure 3E:
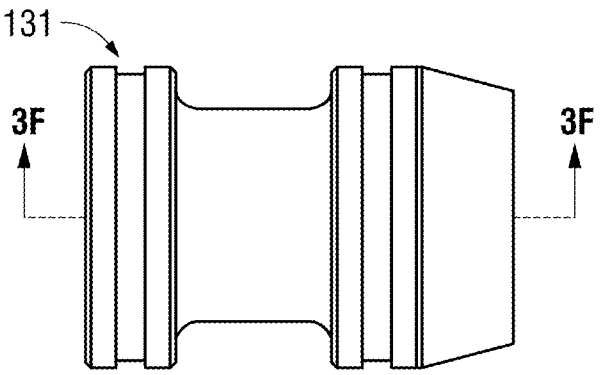
FIGS. 3D through 3F depict aspects of basic check valve spool as applicable to the subject matter of the present disclosure.
Figure 3F:
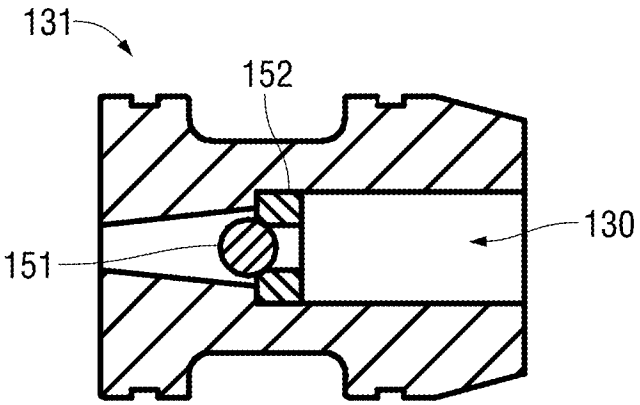
Figure 3C:
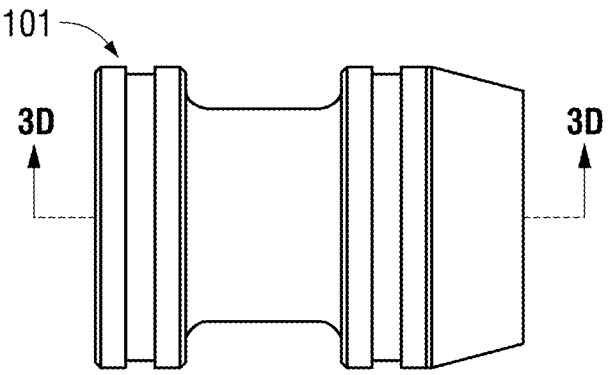
Figure 3D:
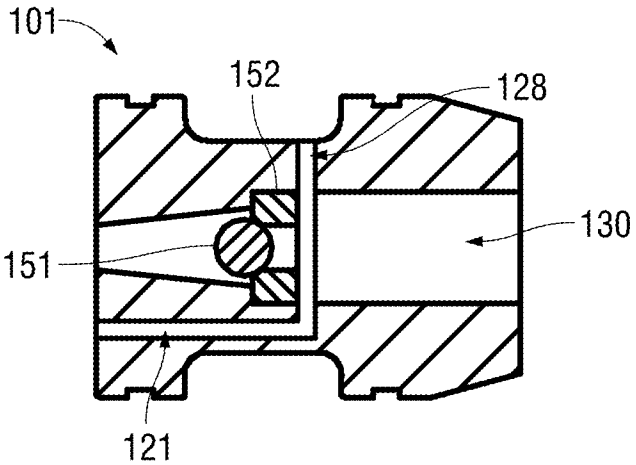

FIG. 3C depicts an external isometric view of check valve spool 101, while FIG. 3D depicts in detail a section view 3D-3D showing the check valve spool 101 which is employed in housing 104 in FIG. 3B. This check valve spool 101 may be used in place of the "plain" spool 18 seen in FIG. 2B when necessary. Check valve spool 101 has two key features, one being capable of housing a nichrome wire 113 looped end and passing the nichrome wire 113 into check valve spool 101 through sealed wire bore 121 (seal and non-conductive insulator not shown) and to extend through transverse bore 128, where it can be placed in contact with a meltable obstruction. Check valve spool 101 also permits easier travel of the check valve spool 101 as it can equalize or adjust pressure on both sides of the spool when minimal movement or short-distance actuation of this spool is necessary. It can be beneficial to check pressurized external flow so as to prevent excess pressure from reaching the portion of the housing 104 located between the check valve spool 101 and high-voltage capacitor 111. In FIG. 3B, this flow-checking action would occur at actuation, sealing check valve spool 101 with ball 151 traveling to, and seating on and sealing, a reduced orifice aperture in check valve spool 101 proximal to high voltage capacitor 111. The check valve spool 101 is comprised of a spool similar to spool 18 in FIG. 2B, but with a central axial throughbore beginning at axial bore 130 which tapers to a reduced orifice aperture at the other end proximal to high voltage capacitor 111. Thus the larger diameter portion of axial bore 130, originating at the end distal from the reduced orifice aperture end, tapers in diameter as it approaches the reduced orifice aperture end. For ease of assembly, the check valve spool 101 can be inserted into housing 104. Subsequently, the ball 151 is temporarily affixed to set screw 152 with adhesive. Set screw 152 can then be threadably inserted into the larger diameter portion of axial bore 130 adjacent to the tapered portion. The set screw 152 retains the ball 151 until a pressure-increasing event occurs on the side of the set screw 152 opposite the ball 151. At the occurrence of a pressure-increasing event, the ball 151 will release from the set screw 152 and travel toward the reduced orifice aperture, where it will seat. When this check valve spool 101 is employed, upon actuation, the ball 151 seats in the reduced orifice aperture and prevents excess pressure from entering the area inside housing 104 located between the high-voltage capacitor 111 and check valve spool 101.

FIG. 3E depicts an isometric view of basic check valve spool 131, shown in section view 3F-3F in FIG. 3F. Basic check valve spool 131 is similar to check valve spool 101 seen above in FIG. 3B and FIG. 3D, but does not incorporate either transverse bore 128 or sealed wire bore 121. Just as in check valve spool 101, basic check valve 131 utilizes a tapering central axial bore, with the larger diameter portion of axial bore 130 originating at the end distal from the reduced orifice aperture end and tapering in diameter as it approaches the reduced orifice aperture end. Ball 151 disengages from set screw 152 when a pressure-increasing event occurs on the side of the set screw 152 opposite the ball 151 and travels to seat at the reduced orifice aperture end. Basic check valve spool 131 is employed in situations requiring pressure-checking action or ease of spool travel, but not requiring nichrome wire insertion or melting a meltable obstruction. Assembly is the same as with check valve spool 101, with basic check valve spool 131 being initially inserted into housing 104. Subsequently, the ball 151 is temporarily affixed to set screw 152 with adhesive, and then set screw 152 can be threadably inserted into the larger diameter portion of axial bore 130 adjacent to the tapered portion.

In another embodiment, a tube has a pressure transducer affixed to one end of the tube, with capacitors, computer, and electric motor inside the tube and proximal to the transducer, with the computer communicating with the transducer. Differing from the previous two embodiments, the end of the tube distal from the transducer is sealed. The only opening to external pressure is a single hole in the middle portion of the tube. A screw, preferably an acme threaded lead screw with nut at its end distal from the motor, is attached to the electric motor, with the electric motor having the capability of turning the screw when receiving a signal from the computer, with the computer sending a signal to discharge a motor-powering capacitor after analyzing pressures sent to it via the transducer. The lead screw is attached to a carrier of balls via a nut, with the holder keeping a collection of balls linearly arranged, separated, and with individual angled tabs to assist in forcing the balls outward when they are advanced to the hole. The electric motor turns the lead screw after receiving a signal from the computer, with the computer sending the signal after analyzing pressures sent to it via the transducer. As the lead screw turns the carrier of balls is retracted toward the transducer end of the tube. As the carrier retracts, a ball becomes aligned with the hole in the middle portion of the tube and is released through the hole. An axial bore through the carrier allows it to pass along the circumference of the lead screw as it is retracted. A positive means of displacing the ball through the opening, such as an inclined tab attached at the wall of the tube opposite the hole and at disposed so that it is aligned with the bottom of the hole proximal to lead screw nut, may be used. Based upon the program in the computer, the lead screw may retract repeatedly and iteratively, so as to sequentially retract a distance to release one ball, or to release a plurality of balls at one time.

Figure 4A:
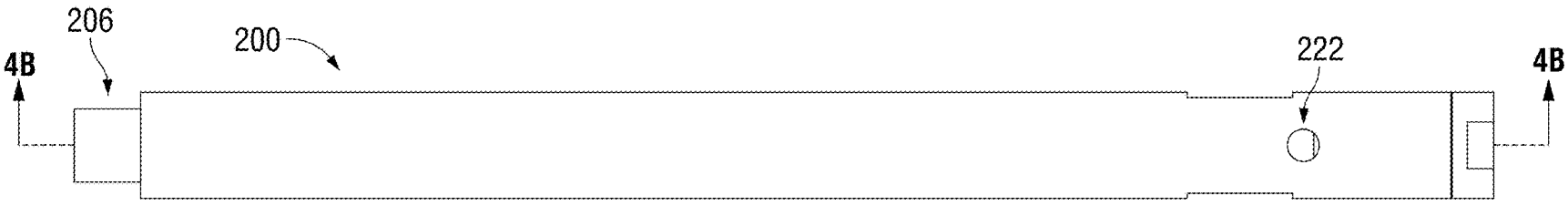
FIGS. 4A and 4B depict an actuator for releasing multiple balls for plugging orifices for the present disclosure.
Figure 4B:
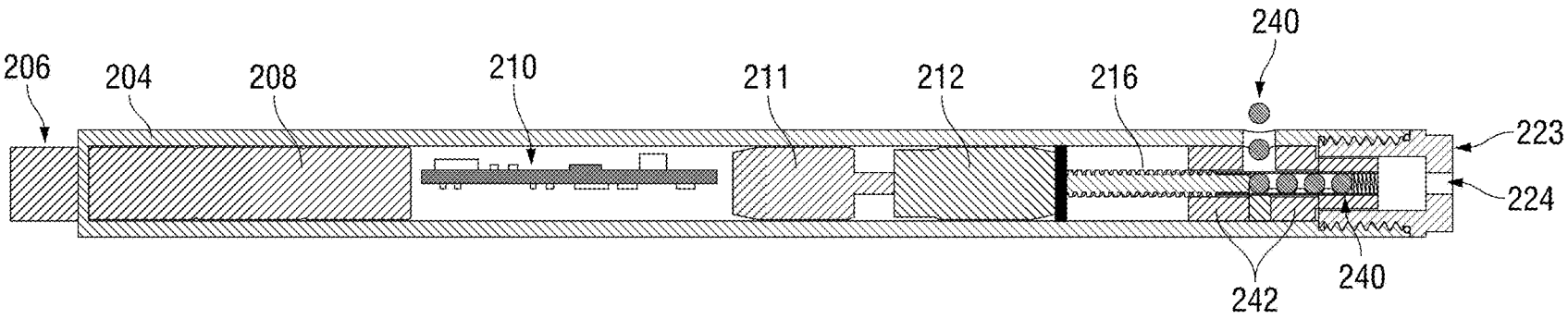

FIG. 4A depicts an actuator 200 in external isometric view, with side hole 222 visible. FIG. 4B shows a section view 4B-4B of actuator 200. Actuator 200 is capable of releasing multiple balls 240 to plug orifices in a given wellbore tool or casing (not shown). Actuator 200 enables screw-operated actuation of a linear ball carrier 242 that retracts as lead screw 216 turns inside engaged threads of linear ball carrier 242. Actuator 200 is comprised of housing 204, made of a material capable of resisting burst or crush pressure, threaded end connection 223 with end hole 224, a pressure transducer 206, capacitor(s) 208, high voltage capacitor 211, a computer 210, an electric motor 212, a linear ball carrier 242, single or multiple balls 240, and side hole 222 that permits balls 240 to exit housing 204. Linear ball carrier 242 has an axial hole bored through it, with said hole exceeding the outside diameter of lead screw 216 and aligned with lead screw 216 so that it passes over the circumference of lead screw 216 as it retracts toward the electric motor 212.

The linear ball carrier 242 is contained within housing 204, and is unsealed and exposed to wellbore pressure, with a large side hole 222 bored transverse to the lead screw 216 and providing an exit opening for balls 240. Opposite the side hole 222, a 45-degree angled tab 218 is affixed to the housing 204, serving to force balls outward and through side hole 222 as the linear ball carrier 242 retracts. Linear ball carrier 242 has a thin channel axially cut through its spine along the side of housing 242 opposite side hole 222 to accommodate angled tab 218. Upon receipt of the required pressure ratios at the pressure transducer 206, analysis of these ratios is performed by computer 210 using the process described in this disclosure, and with correct ratios, the computer 210 proceeds to signal the high-voltage capacitor 211 to discharge and deliver current. The high-voltage capacitor 211 discharges, sending electric current to the electric motor 212, which causes the electric motor 212 to rotate the lead screw 216 in order to move, or "retract," the linear ball carrier 242 toward the electric motor 212.

Programming of the computer 210 may vary the instructions to actuate after employing the process described above in this disclosure. For example, upon receiving the correct pressure ratios, the computer 210 can retract the linear ball carrier 242 such that it retracts sufficiently for a single ball 240 to exit at large side hole 222. Upon receiving the correct pressure ratios a subsequent time, the computer 210 could advance another ball 240, and proceed to sequentially repeat this separate actuation as required. Alternatively, the computer could advance the linear ball carrier 242 such that it moves multiple, or all, balls 240 to exit at large side hole 222.

Another embodiment consists of a spool inside a tube that has seals on each end of the spool as well as a third seal in a middle part of the spool. These seals seat against the tube wall. In a first area of the spool, between two of the seals, the tube housing the spool has a hole or plurality of holes in a circumferential, radial area. In a second area of the spool, a transverse hole in the spool connects to a central axial hole in the spool that extends from the second area through the end of the spool toward the end of the tube with the hole. A meltable, frangible or dissolvable obstruction or blocking "dog", comprised of a material such as silver solder, is positioned in the tube beyond the end of the spool and contacting the spool. A pressure transducer is affixed to one end of the tube, with capacitors, and computer inside the tube and proximal to the transducer, with the computer communicating with the transducer, and a hole is located in the opposite end of the apparatus, distal from the transducer end. A compression spring (or in a sub-embodiment, tension spring) is attached on one end to the capacitor compartment and on the other end to the spool. A high-voltage capacitor next to the computer connects to nichrome wire that contacts the meltable or frangible obstruction. The spool is either made of a non-conductive material or has portions contacting the nichrome wire insulated so as to prevent nichrome wire from contacting any conductive parts of the spool.

In order to prevent the spool from moving due to compression from the spring and allowing external pressure to push flow through the hole at the end of the tube, said meltable, frangible or dissolvable obstruction, such as a tab made of silver solder, holds the spool in place. Nichrome wire connecting directly or indirectly to the capacitor, contacts the obstruction and preferably intermingles with it. Upon receiving a signal from the computer, the capacitor sends current through the highly resistant nichrome wire, heating it up rapidly, and the obstruction melts, allowing the spring to move the spool so that the second area of the spool with the transverse hole passes under the hole(s) in the side of the tube, allowing fluid from outside the tube to enter the spool and pass through the hole at the end of the tube.

The spool is either made of a non-conductive material or has portions contacting the nichrome wire insulated so as to prevent contact with any conductive parts of the spool.

Figure 5A:
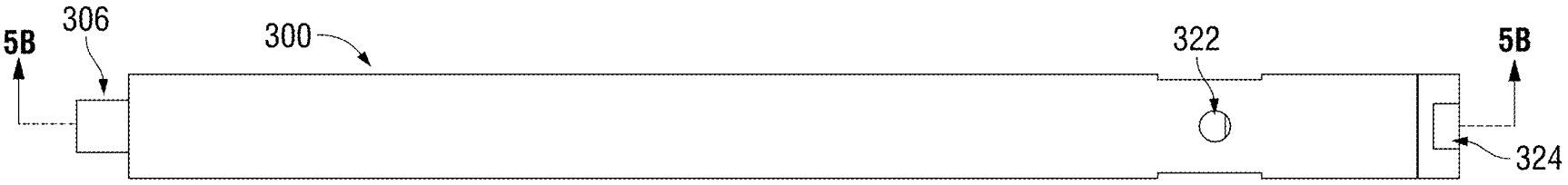
FIGS. 5A and 5B present an actuator for advancing a spool to open a flow passageway to actuate a separate downhole device according to the present disclosure.
Figure 5B:
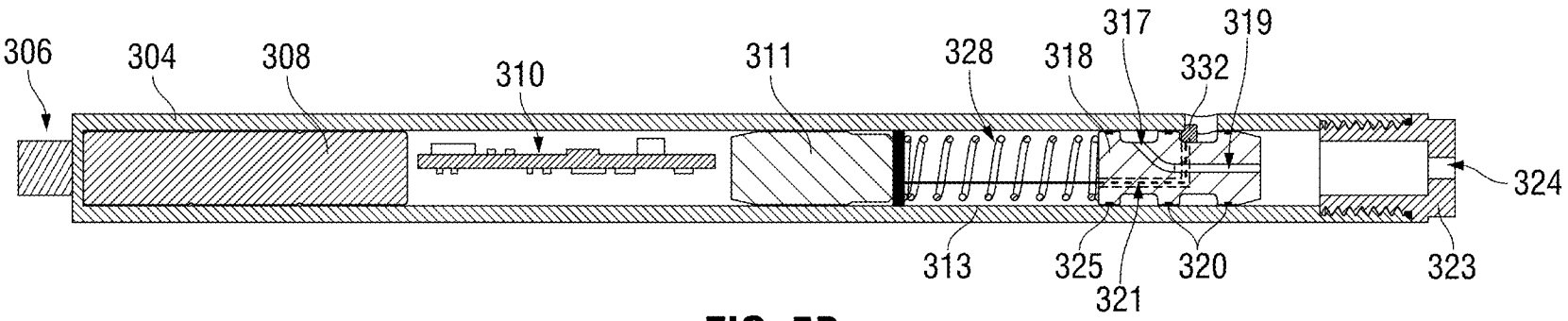

FIGS. 5A and 5B present an actuator for advancing a spool to open a flow passageway to actuate a separate downhole device according to the present disclosure. FIG. 5A depicts an actuator 300 in isometric view with end hole 324 and transducer 306 visible. FIG. 5B depicts a section view 5B-5B with a compressed spring 328 capable of advancing a spool 318 in order to open a flow passageway to actuate a separate downhole device (not shown). Also shown are a housing 304, made of a material capable of resisting burst or crush pressure, a pressure transducer 306, capacitor(s) 308, high-voltage capacitor 311, a computer 310, and nichrome wire 313, with said nichrome wire 313 extending through compressed spring 328 and into axial bore 319 in spool 318. Spool 318 is held in the initial position by a meltable obstruction 332 that binds to housing 304 and spool 318 and can be made large enough to mechanically prevent travel of spool 318. Spool 318 has two O-rings 320 located proximal to end hole 324 and with O-rings 320 disposed about its circumference for sealing between spool 318 and housing 304. Side hole 322 is shown bored transverse to the portion of the spool 318 located between O-rings 320, with side hole 322 exposing this area to external wellbore pressure. A meltable obstruction 332 that contacts the spool 318 and the housing 304 wall prevents movement of the compressed spring 328 and spool 318 in the direction of end hole 324, an orifice in threaded end connection 323. An axial bore 319 in spool 318 extends from the end of spool 318 that is proximal to end hole 324 and completely through spool 318 to the area inside housing 304 that houses compressed spring 328. A radial spool bore 317 is shown bored at an angled entry in the spool 318 from an area between the two O-rings proximal to the spring and extending to a depth sufficient to intersect axial bore 319. A spring-proximal O-ring 325 seals the portion of the housing 304 that houses compressive spring 328. The portion of spool 318 between spring-proximal O-ring 325 and adjacent O-ring 320 is in fluid communication with end hole 324 and a separate downhole device (not shown). Upon receipt of the required pressure ratios at the pressure transducer 306, analysis of these ratios is performed by computer 310, and with correct ratios, the computer 310 proceeds to signal the high-voltage capacitor 311 to discharge and send current to the nichrome wire 313.

The nichrome wire 313 extends through sealed wire bore 321, with its loop end intersecting and enmeshed into the meltable obstruction 332. Adjacent to the enmeshed-in-meltable-obstruction portion of nichrome wire 313, it may pass through an insulating material (not shown) such as a ceramic material and pressure-sealing gland (not shown) if needed. The nichrome wire 313 has each of its two ends connected to the high-voltage capacitor 311, with the looped end being enmeshed in the meltable obstruction 332. Unshown insulating material could be used for the nichrome wire 313 to avoid direct contact with the spool 318, and in some configurations, a pressure-sealing gland (not shown) could be employed in the portion of spool 318 between O-rings 320 and adjacent to the point where nichrome wire 313 contacts meltable obstruction 332. Upon the receipt of the required pressure ratios at the pressure transducer 306 and analysis of these ratios by computer 310, the computer 310 sends a signal to discharge the high-voltage capacitor 311. When the high voltage capacitor 311 is discharged, the highly electrically resistant nichrome wire 313 rises rapidly in temperature such that the generated heat is sufficient to melt the obstruction 332. Without the obstruction, the stored energy in the compressed spring 328 is freed, permitting the compressed spring to advance the spool 318 in the direction of end hole 324, until spool 318 contacts the proximal end of threaded end connection 323, whose inside diameter is smaller than that of housing 304. The threaded end connection 323 is sized such that its length stops movement of the spool 318 at the point where side hole 322 is disposed between spring-proximal O-ring 325 and its adjacent proximal O-ring 320 and in fluid communication with radial spool bore 317. Pressurized flow enters through side hole 322, passes through radial spool bore 317, passes through axial bore 319 and exits through end hole 324 to a hydraulically connected downhole device (not shown), such as a hydraulic anchor, packer, or similar tool.

Another embodiment delivers considerable torque to turn a screw for a relatively short duration. This embodiment is comprised of a tube with a pressure transducer affixed to one end of the tube, capacitor for powering electronics, computer, capacitor for powering actuation, and electric motor inside the tube and proximal to the transducer, with the computer communicating with the transducer. The capacitor for powering the electronic components is positioned adjacent to the computer and the capacitor for powering actuation is positioned adjacent to the electric motor. The capacitors may be in the form of a supercapacitor or ultracapacitor, such as those produced by Nanoramic Laboratories, and may incorporate a DC to DC (direct current to direct current) converter. The tube is open at the end distal from the transducer end. A screw, preferably an acme threaded screw with incorporated and threadably matching sealed nut or worm gear, is attached to the electric motor, with the electric motor, powered by a capacitor, having the capability of turning the screw when receiving a signal from the computer, with the computer sending said signal after analyzing pressure ratios according to the process disclosed above. The signal sent from the computer activates the electric motor with power from the capacitor, supercapacitor or ultracapacitor. The electric motor turns for a short time with significant torque, due to the burst of power from the capacitor, supercapacitor or ultracapacitor.

Upon the electric motor's initiation of rotation, the screw extends axially out of the tube from its initial position, and advances farther out of the tube, in the direction away from the transducer end. At the end of the screw distal from the transducer, the screw is attached to a sliding sleeve (not shown), part of a tubular assembly in which the sliding sleeve and a tubular body each have alignable holes, well known in the art and commonly used in modern oil and gas industry operations. The screw advances the sliding sleeve to either move the holes into alignment with a tubular body, permitting throughflow, or, alternatively, to move the holes out of alignment with a tubular body, preventing throughflow. This is to say that this embodiment moves a sliding sleeve into an open or closed position. Exemplary applications of this embodiment would be, for example, closing a bypass valve to stop circulation from the drill string to the annulus, actuating a differential pressure valve, or advancing into the open position a sleeve on a ported sub at the toe of a lateral wellbore.

Depending upon programming and electrical power capacity, this embodiment can receive correct pressure ratios sequentially, one after another, and be actuated several times, utilizing a sleeve to sequentially close or open sets of ports upon receiving pressure ratio signals. The screw could be programmed to alternately advance and retract sequentially as well.

A sub-embodiment of this high-torque embodiment is a screw release mechanism instead of screw advancement mechanism. The end of the screw distal from the transducer can be attached to a mating threaded orifice on a sliding sleeve. Rather than advancing the lead screw outward or retracting it inward by utilizing a threaded nut or worm gear as in the previous embodiment, the lead screw is fixed to the electric motor spindle. Upon receiving a signal from the computer, instead of advancing the screw with positive force to attachably advance an adjacent component, the screw unthreads and disengages the mating threads of a sliding sleeve, releasing a sliding sleeve (or other device) from its initial position, and enabling the sliding sleeve to advance after release via work string flow, spring tension, or spring compression.

Another sub-embodiment of this high-torque embodiment is a valve open or close mechanism instead of screw advancement mechanism. The end of the screw distal from the transducer can be attached to a dart, gate, ball valve, or other type of valve actuable with rotation. Upon receiving a signal from the computer, instead of advancing a screw with positive force, the screw opens or closes and attached dart, gate, or ball valve.

Figure 6A:
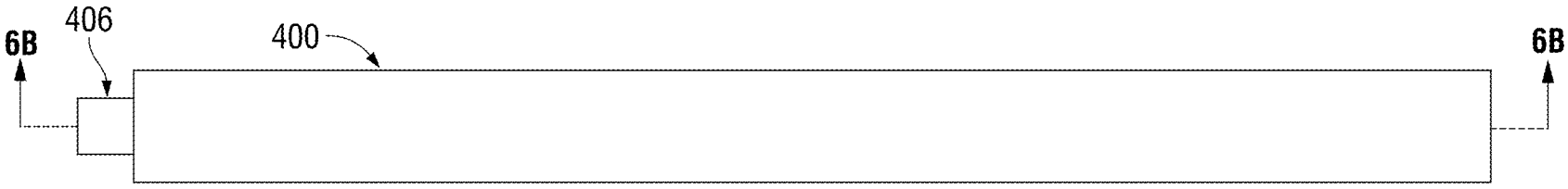
FIGS. 6A and 6B highlight an actuator in accordance with the present teachings.
Figure 6B:
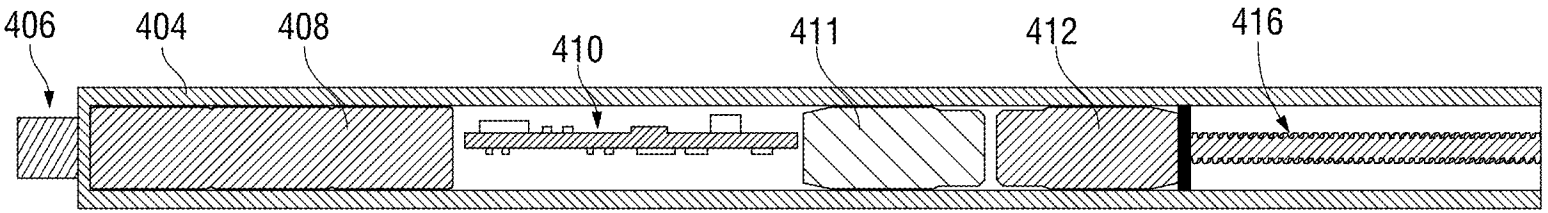

FIGS. 6A and 6B highlight an actuator in accordance with the present teachings. FIG. 6A depicts an actuator 400 in isometric view. FIG. 6B depicts in section view 6B-6B actuator 400, with said actuator of rotating lead screw 416 with significant torque in order to a) advance an adjacent component, b) retract an adjacent component, c) release an adjacent component (not shown) from engagement, or actuate a valve (not shown) with said lead screw 416. Actuator 400 is comprised of housing 404, made of a material capable of resisting burst or crush pressure, a pressure transducer 406, capacitor(s) 408, a high-voltage capacitor 411, a computer 410, an electric motor 412, and a lead screw 416. Housing 404 is open at the end distal from transducer 406 with lead screw 416 protruding from this open end. Upon receipt of the required pressure ratios at the pressure transducer 406, analysis of these ratios is performed by computer 410, and with correct ratios, the computer 410 proceeds to signal the high-voltage capacitor 411 to discharge and deliver electric current. The high-voltage capacitor 411 discharges and sends electric current to the electric motor 412, which causes the electric motor 412 to rotate the lead screw 416 in a direction such that said lead screw 416 advances or retracts an adjacent component (not shown), or unthreads from and releases from a threadably attached component (not shown). Programming of the computer 410 may vary the instructions to actuate after employing the process described above in this disclosure. For example, upon receiving the correct pressure ratios, the computer 410 can advance, retract, or release an adjacent component, perform a combination of these actions, or repeat these actions or combinations of actions sequentially upon receiving the correct pressure ratios subsequent times.

Another embodiment is an actuable release mechanism comprised of a tube with a pressure transducer affixed to one end of the tube, with capacitor(s) for powering a computer, computer, and power device in addition to the computer-powering capacitors. The power device may be a battery, capacitor, supercapacitor or ultracapacitor and may incorporate a DC to DC converter. The end of the tube distal from the transducer end is open. Wires run from the power device to an explosive bolt or similar explosively releasing item, known in the art and produced by companies such as Pacific Scientific Energetic Materials Company. After analyzing pressure ratios according to the process disclosed above, the computer sends a signal that allows electric current from the power device to flow through the wires to the explosive bolt. The explosive bolt is attached to a sliding sleeve or similar actuable item, with the explosive bolt being inserted into a hole in the sliding sleeve and retaining the sliding sleeve in a first position. The current sent to the explosive bolt from the power device causes it to break or explode into pieces, releasing the sliding sleeve and enabling it to move into a second position. Upon release, the sliding sleeve is enabled to advance via downhole fluid flow, spring tension, or spring compression.

Figure 7A:
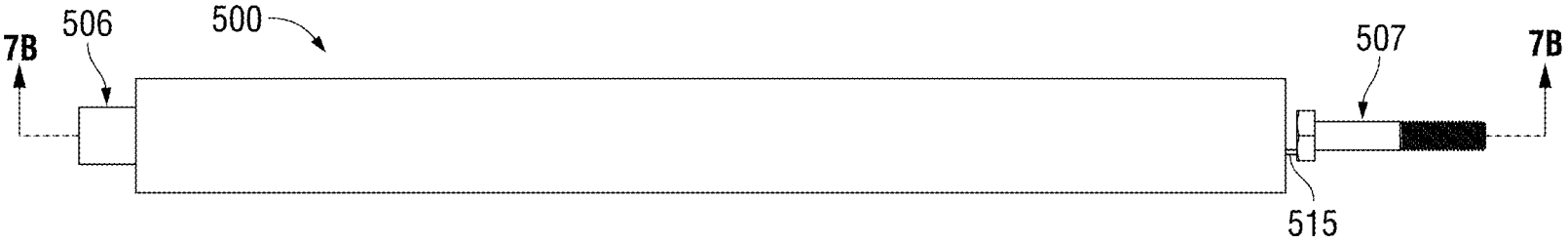
FIGS. 7A and 7B depict an explosive actuator applicable to the presently disclosed subject matter.
Figure 7B:
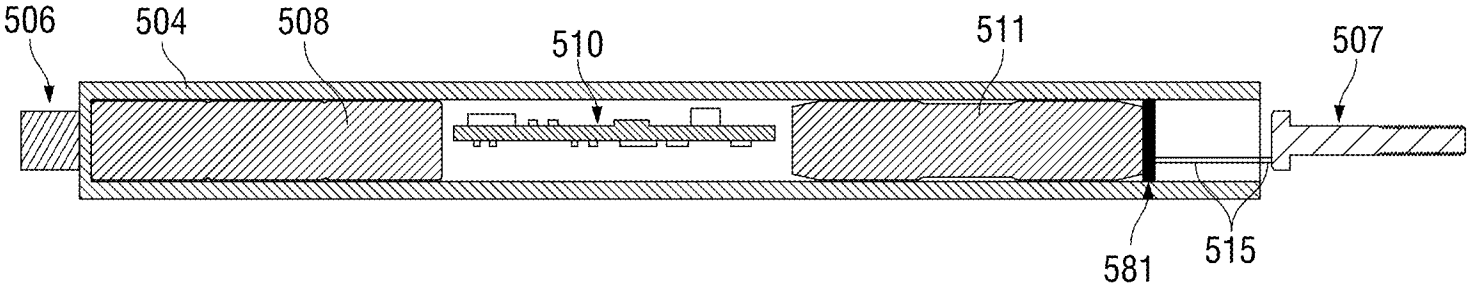

FIGS. 7A and 7B depict an explosive actuator applicable to the presently disclosed subject matter. FIG. 7A depicts an explosive actuator 500 in external isometric view, with transducer 506, electrical wires 515 and explosive bolt 507 visible. FIG. 7B shows actuator 500 in section view 7B-7B, including the housing 504 with a pressure transducer 506 affixed to one end of the tube and an explosive bolt 507 such as those available from Pacific Scientific Energetic Materials Company or similar explosive frangible component electrically wired at the end distal from transducer 506. Explosive actuator 500 is further comprised of housing 504, made of a material capable of resisting burst or crush pressure, a pressure transducer 506, a computer 510, capacitor(s) 508, a high-voltage capacitor 511, and electrical wires 515. Upon receiving the correct pressure ratios, having applied the process described above in this disclosure, the computer 510 can signal high-voltage capacitor 511 to discharge, sending current along electrical wires 515 and causing the explosive bolt 507, which is electrically wired to high-voltage capacitor 511, to explode or otherwise break apart, releasing a sliding sleeve or similar component (not shown) retained by explosive bolt 507. A plurality of explosive bolts 507 may be employed to retain a single or multiple components, such as sliding sleeves. Depending on programming, the computer 510 can repeat the exploding of explosive bolts 507 multiple sequential times upon repeatedly receiving the correct pressure ratios subsequent times.

Another embodiment is comprised of a tube with a pressure transducer affixed to one end of the tube, with capacitors, computer, and power device, such as a high-voltage capacitor, in addition to the capacitors powering the computer. The power device may be a capacitor, supercapacitor or ultracapacitor and may incorporate a DC to DC converter. Adjacent to the power device, either in the same tube, past a compression resistant bulkhead, or, in a separate tube, connected by electrical wires, a spool is positioned inside the tube. The tube is sealed on one end and has an opening at the other end, where it connects to a separate downhole device. The spool has seals on each end of the spool that seat against the tube wall. The spool has an axial bore extending through the length of the spool. The tube has a hole or plurality of holes in a circumferential, radial area, with such holes being positioned between the seals of the spool located inside the tube. A hole is located in the end of the tube. An explosive push device, known in the art and supplied by such companies as Pacific Scientific Energetic Materials Company, is positioned distally from the hole in the end of the tube and abuts the spool with its piston end touching the spool.

The explosive push device is connected to the power device by wires. After analyzing pressure ratios according to the process disclosed above, the computer sends a signal that allows current from the power device to flow through the wires to the explosive push device. The current sent to the explosive push device causes its piston to advance forward a small distance, in this case pushing the spool toward the end with the hole in it. The seals travel beyond the hole(s) in the side of the tube and the seals and spool no longer act as the tube's barrier to external pressure. Fluid enters the tube through the hole(s) in the side of the tube and passes through the spool's axial bore and through the hole at the end of the tube.

The instant embodiment can be constructed in one or two pieces. In a two-piece version, the transducer, capacitors, computer and power device may be housed in one tube, and the explosive push device and spool may be housed in a separate sealed tube. In this case, the two tubes are connected by wires running from the power device through a pressure sealed gland and into the second tube through a pressure sealed gland where the wires connect to the explosive push device.

In a one-piece version, the transducer, capacitors, computer, power device as well as the explosive push device and spool are housed in a single sealed tube. However, in order to mitigate the potential effects of a detonation on adjacent parts of the embodiment, a compression resistant wall or bulkhead may be placed between the transducer, capacitors, computer, power device portion and the explosive push device and spool portion. In such a case, wires running through the bulkhead connect the power device to the explosive push device.

Figure 8A:
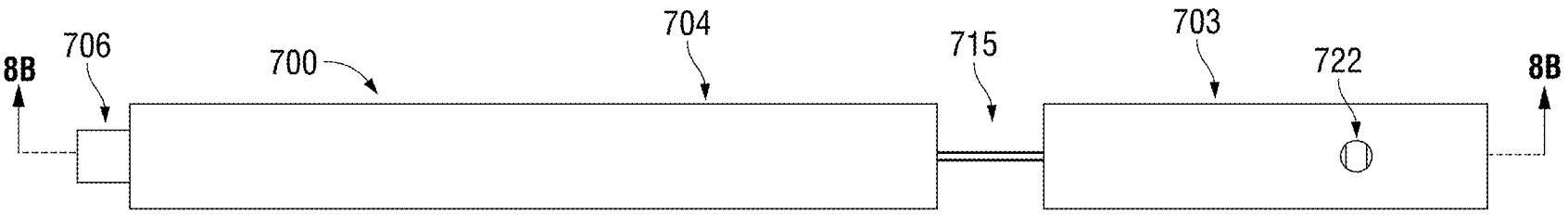
FIGS. 8A and 8B show an explosive actuator with pressure transducer and explosive push device according to the present subject matter.
Figure 8B:
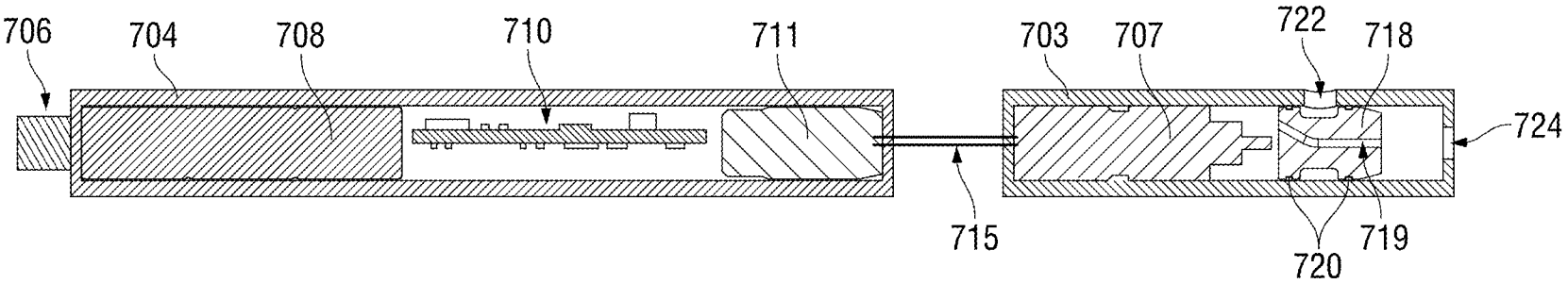

FIGS. 8A and 8B show an explosive actuator with pressure transducer and explosive push device according to the present subject matter. FIG. 8A depicts a two-piece explosive actuator 700, connected by electrical wires 715, in external isometric view. FIG. 8B depicts actuator 700 in section view 8B-8B comprised of a housing 704 with a pressure transducer 706, and a second housing 703 containing an explosive push device 707. This explosive actuator 700 is further comprised of housing 704, made of a material capable of resisting burst or crush pressure, second housing 703, made of a material capable of resisting burst or crush pressure, a pressure transducer 706, a computer 710, capacitor(s) 708, a high-voltage capacitor 711, a spool 718, and electrical wires 715. Housing 704 and second housing 703 are separate and connected by electrical wires in the event that it is desired to locate the control function and explosive actuation function in disparate locations in the wellbore. Housing 704 has transducer 706 located on one end and electrical wires 715 extending out from the other end, and connecting high-voltage capacitor to explosive push device 707 through the closed end of second housing 703. Second housing 703 houses spool 718, a portion of which is sealed against the inner wall of second housing 703 by two O-rings 720 which abut the circumference of spool 718 and inner wall of the second housing 703. An axial bore 719 extends through spool 718. One end of second housing 703 is closed, with explosive push device 707 disposed between the closed end and spool 718. Electrical wires 715 enter through a gland at the closed end of spool 718 and attach to electrical terminals in explosive push device 707. An end hole 724 is located at the end distal from the closed end of second housing 703. The end hole 724 connects to a separate actuable downhole device (not shown). A side hole(s) 722 is bored in the second housing 703 transversely to the spool and is shown disposed between O-rings 720. Upon receiving the correct pressure ratios, and having applied the process described above in this disclosure, the computer 710 signals high-voltage capacitor 711 to discharge current over electrical wires 715 to explosive push device 707. The current causes the explosive push device 707 to detonate an internal charge that drives its piston forward, advancing the spool 718 in the direction of the end hole 724. The O-rings 720 advance past side hole(s) 722 and external pressurized flow from the wellbore enters second housing 703 through side hole(s) 722 and then passes through the axial bore 719 and through exit hole 724. A plurality of explosive push devices 707 may be employed to actuate multiple components, such as shearable items for actuating sliding sleeves, valves, and piston-actuated devices (not shown). Depending on programming, the computer 710 can repeat the detonation of explosive push devices 707 multiple sequential times upon repeatedly receiving the correct pressure ratios subsequent times.

Figure 8C:
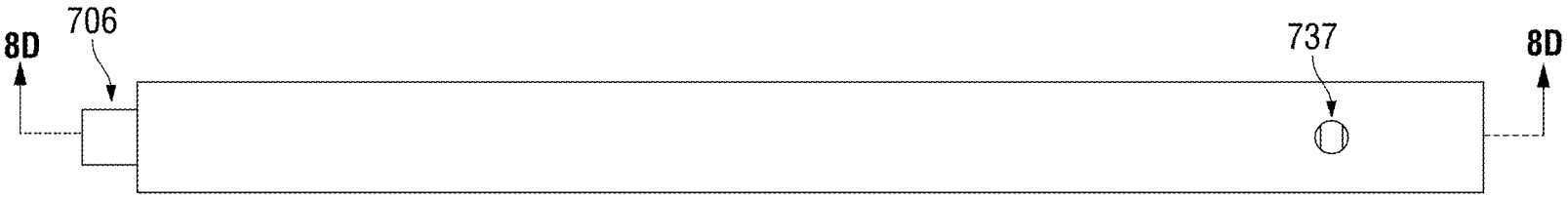
FIGS. 8C and 8D depict a one-piece, single housing version of the explosive actuator shown in FIG. 8A.
Figure 8D:
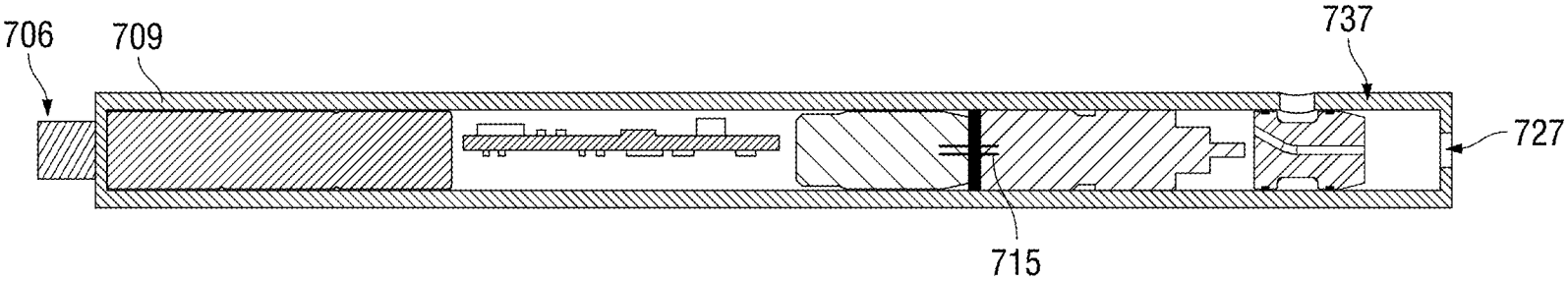

FIGS. 8C and 8D depict a one-piece, single housing version of the explosive actuator shown in FIG. 8A. FIG. 8C depicts, in external isometric view, a one-piece, single housing version of the explosive actuator 700 shown in FIG. 8A. FIG. 8D depicts he explosive actuator 700 with a single housing 709 containing explosive push device 707.

Explosive actuator 700 is further comprised of housing 709, made of a material capable of resisting burst or crush pressure, a pressure transducer 706, a computer 710, capacitor(s) 708, a high-voltage capacitor 711, a spool 718, and electrical wires 715. At the end of housing 709 distal from transducer 706, spool 718 is housed. A portion of spool 718 is sealed against the inner wall of housing 709 by two O-rings 720 which abut the circumference of spool 718 and inner wall of the second housing 709. An axial bore 719 extends through spool 718. Explosive push device 707 is disposed between the high-voltage capacitor 711 and spool 718. Electrical wires 715 connect the high-voltage capacitor 711 to electrical terminals in explosive push device 707. An end hole 727 is located at the end distal from the pressure transducer 706. The end hole 727 connects to a separate actuable downhole device (not shown). A side hole(s) 737 is bored in the housing 709 transversely to the spool 718 and is shown disposed between O-rings 720. Upon receiving the correct pressure ratios and applying the process described above in this disclosure, the computer 710 signals high-voltage capacitor 711 to discharge current over electrical wires 715 to explosive push device 707. The current causes the explosive push device 707 to detonate an internal charge that drives its piston forward, advancing the spool 718 in the direction of the end hole 727. The O-rings 720 advance past side hole(s) 737 and external pressurized flow from the wellbore enters housing 709 through side hole(s) 737 and then passes through the axial bore 719 and through exit hole 727. A plurality of explosive push devices 707 may be employed to actuate multiple components, such as piston-actuated devices (not shown). Depending on programming, the computer 710 can repeat the detonation of explosive push devices 707 multiple sequential times upon receiving the correct pressure ratios subsequent times.

Another embodiment utilizes a screw that is encircled by a compression spring with the screw serving to release the compression spring so that it advances a spool to permit flow. This embodiment is comprised of a tube with a pressure transducer affixed to one end of the tube, capacitor for powering electronics, computer, capacitor for powering actuation, and electric motor inside the tube and proximal to the transducer, with the computer communicating with the transducer. The capacitor for powering the electronic components and the capacitor for powering actuation are positioned adjacent to the electric motor. The capacitors may be in the form of a supercapacitor or ultracapacitor, such as those produced by Nanoramics, and may incorporate a DC to DC (direct current to direct current) converter.

A compression spring is disposed around the circumference of a lead screw, preferably with Acme threads, in this embodiment. The spring is retained in a compressed state by a retaining nut. The retaining nut threadably attaches to the lead nut and possesses a large diameter flange portion located at the end of the nut located distal from the capacitor(s). The large diameter flange portion of the nut is of a diameter larger than the diameter of the compressed spring, such that the nut retains the spring in its compressed state. After analyzing pressure ratios according to the process disclosed above, the computer sends signals a capacitor to discharge. The discharging capacitor causes the connected electric motor to begin rotating. As the motor rotates the attached lead screw, it unthreads itself from the threadably attached retaining nut, releasing the nut. Upon released of the nut, the compressed spring releases its stored energy, pushing the nut against the spool and advancing the spool toward the distal end of the tube, enabling pressurized flow from the wellbore to enter the tube, flow through passageways in the spool, and flow through a hole at the end of the tube to a hydraulically connected downhole device (not shown).

The tube has a hole or plurality of holes bored transverse to the spool and located, initially, between two O-rings on the circumference of the spool, with these O-rings located proximal to the hole at the end of the tube. These two O-rings seal the hole(s) in the tube such that external pressurized flow cannot enter the remainder of tube in the initial position. A third O-ring is located proximal to the retaining nut. Between this O-ring proximal to the retaining nut and the adjacent O-ring, a transverse, radial hole is bored in the spool to a depth that reaches the center of the spool. An axial bore extends from the end of the spool proximal to the hole at the end of the tube to the point at which it intersects the transversely bored hole in the spool. The holes in the spool are thus in fluid communication with the hole at the end of the tube.

With the spring released, it pushes the nut against the spool and advances the spool toward the end of the tube with the hole. The spool advances past the middle O-ring and contacts a mechanical stop in the tube. The spool stops its advance at a point in which the hole(s) in the side of the tube are disposed between the middle O-ring and the O-ring proximal to the retaining nut. In this second position, external pressurized flow enters the tube and passes through the passageways in the spool and through the hole at the end of the tube. A separate downhole device (not shown), hydraulically connected to the hole at the end of the tube, is actuated.

Figure 9A:
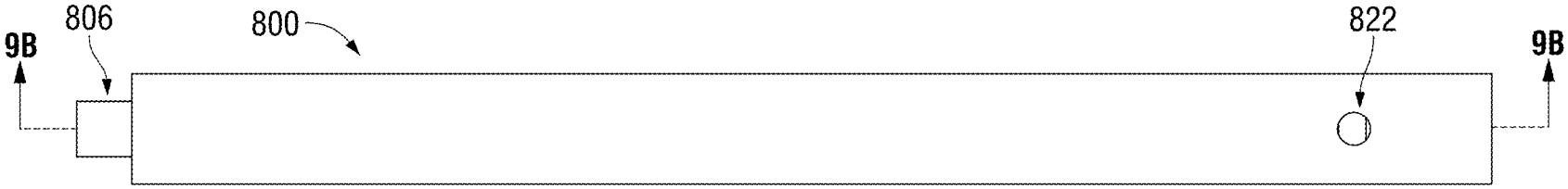
FIGS. 9A through 9D depict an actuator for advancing a spool and permitting throughflow according to the present subject matter.
Figure 9B:
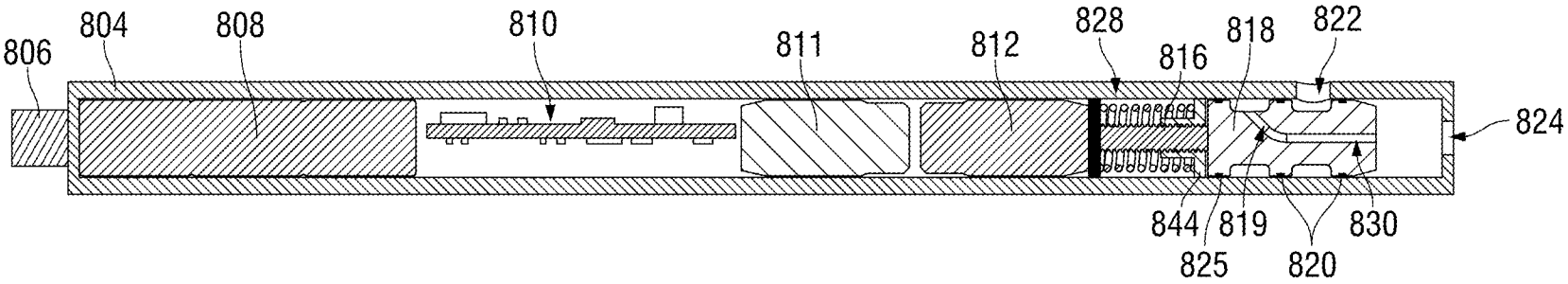
Figure 9C:
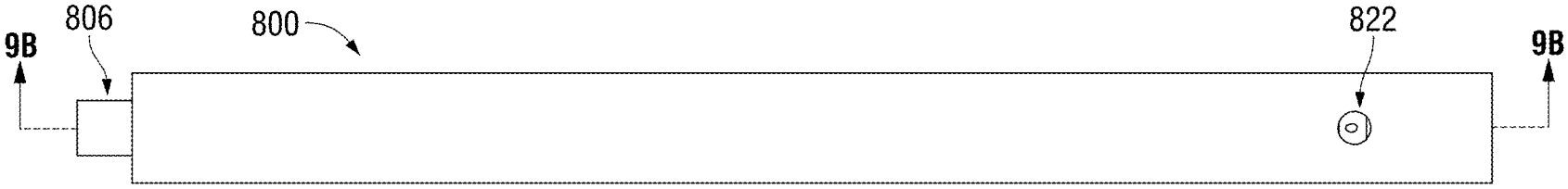

FIGS. 9A through 9D depict an actuator for advancing a spool and permitting throughflow according to the present subject matter. FIG. 9A depicts an external, isometric view of actuator 800, with transducer 806 and side hole 822 visible. FIG. 9B depicts a section view 9B-9B of actuator 800 in a first position. Actuator 800 utilizes a rotating lead screw 816 encircled by a compression spring 828, with the lead screw 816 serving to release the compression spring 828 so that it advances a spool 818 and permits throughflow. Actuator 800 is comprised of housing 804, made of a material capable of resisting burst or crush pressure, a pressure transducer 806, capacitor(s) 808, a high-voltage capacitor 811, a computer 810, an electric motor 812, a lead screw 816, a compression spring 828, and a retaining nut 844. Upon receipt of the required pressure ratios at the pressure transducer 806, analysis of these ratios is performed by computer 810, and with correct ratios, the computer 810 proceeds to signal the high-voltage capacitor 811 to discharge and deliver electric current. The high-voltage capacitor 811 discharges and sends electric current to the electric motor 812, which causes the electric motor 812 to rotate the lead screw 816 in a direction such that said lead screw 816 unthreads itself from the retaining nut 844. When the retaining nut 844 is released, freeing the compression spring 828 and its stored energy. The compression spring pushes the retaining nut 844 against the spool 818 and advances the spool toward the end hole 824 located at the distal end of housing 804. A mechanical stop 845, in FIG. 9B simply the end of housing 804, limits the travel of the spool 818.

Figure 9D:
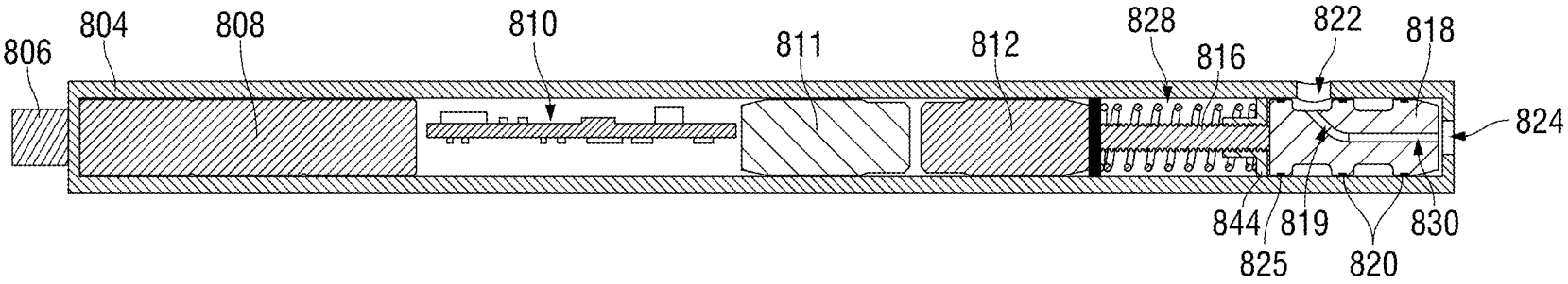

FIG. 9C again depicts an external, isometric view of actuator 800. FIG. 9D depicts actuator 800 in section view 9B-9B and shows the actuator 800 in a second position. The housing 804 has a hole or plurality of side hole(s) 822 bored transverse to the spool 818 and located, in the shown first position, between two O-rings 820 on the circumference of the spool 818, with these O-rings 820 located proximal to the end hole 824 at the end of the tube. These two O-rings seal the side hole(s) 822 in the housing 804 such that external pressurized flow cannot enter the remainder of housing 804 in the initial position. A third O-ring, the retaining nut-proximal O-ring 825, is located proximal to the retaining nut 844. Between this nut-proximal O-ring 825 and the adjacent O-ring 820, a radial spool bore 819 is bored in the spool 818 to a depth that reaches the center of the spool 818. An axial bore 830 extends from the end of the spool 818 proximal to the end hole 824 to the point at which it intersects the radial spool bore 819 in the spool 818. The holes in the spool are thus in fluid communication with the end hole 824. With the compression spring 828 released, it pushes the retaining nut 844 against the spool 818 and advances the spool 818 toward the end of the housing 804 with the end hole 824. The spool 818 advances so that the middle O-ring 820 goes past side hole(s) 822. The spool 818 contacts a mechanical stop 845 in the housing 804 and ceases its advance. The spool 818 stops its advance at a point in which side hole(s) 822 are disposed between the middle O-ring 820 and the retaining nut-proximal O-ring 825. In this second position, external pressurized flow enters the housing 804 and passes through the radial spool bore 819 and axial bore 830 and through the end hole 824. A separate downhole device (not shown), is hydraulically connected to the end hole 824 and actuated.

Another embodiment is an explosive latch actuator that utilizes an explosive push device to actuate a latch mechanism. The actuator houses its components in a tube, with said components including an explosive push device connected to a power device, such as a high-voltage capacitor, by electrical wires. After analyzing pressure ratios according to the process described above in this disclosure, the computer sends a signal that allows current from the power device to flow through the electrical wires to the explosive push device. The current sent to the explosive push device causes its piston to advance forward a small distance, in this case the explosive push device's piston abutting and pushing a latch into an unlocked position, in this process causing the latch to release its mating latch keeper, and in turn freeing a compressed spring which had been retained by the latch to advance a piston contiguous with the mating latch keeper. The latch keeper-piston has an internal passageway bored in rod axial bore along its axis, with said passageway turning 90 degrees to exit the side of the latch piston transversely through a piston transverse bore. At the piston transverse bore, the now-advanced piston's piston transverse bore hole fluidly connects with a transversely bored side hole(s) in the tubular housing. External pressurized flow can enter through the side hole(s) in the tubular housing, pass through the piston transverse bore and rod axial bore, exit the piston and flow through an end hole in a threaded piston barrel at the end of the housing. The end hole hydraulically connects with a separate downhole device, such as a hydraulic anchor or similar downhole tool.

Figure 10A:
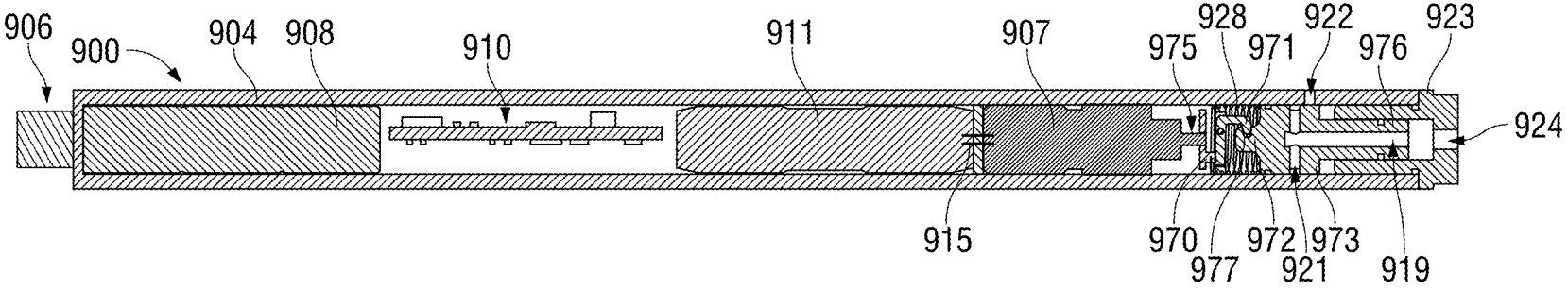
FIGS. 10A and 10B depict section views of the explosive latch actuator according to the present disclosure.
Figure 10B:
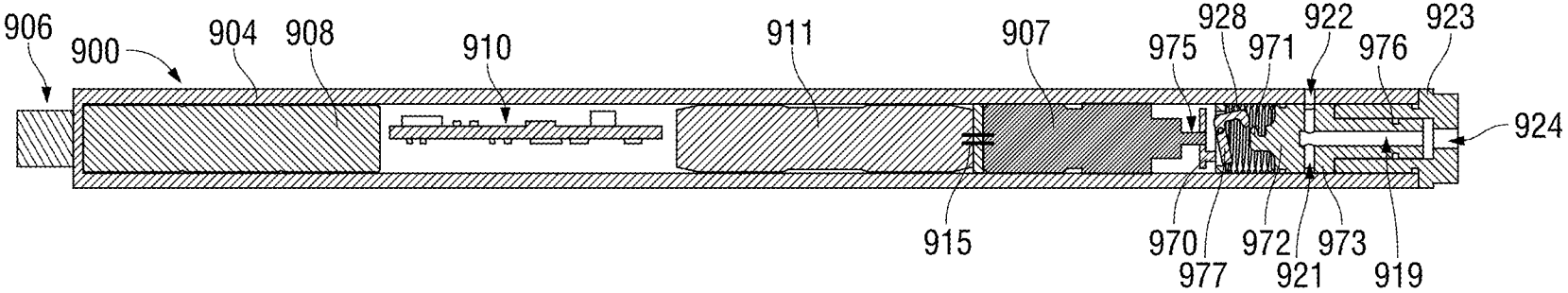

FIGS. 10A and 10B depict section views of the explosive latch actuator according to the present disclosure. FIG. 10A depicts a half section view of the explosive latch actuator 900, which includes a tubular housing 904 that houses explosive push device 907 and integrated latch-keeper piston 972. In detail, explosive actuator 900 is comprised of a housing 909, made of a material capable of resisting burst or crush pressure, a pressure transducer 906, a computer 910, capacitor(s) 908, a high-voltage capacitor 911, and an explosive push device 972 that extends a push device piston 975 with significant force when activated. In a first position shown in FIG. 10A, adjacent to explosive push device piston 975 is latch 970. Latch 970 retains latch-keeper piston, a contiguous latch keeper and piston, at keeper 977, a keeper that mates latch 970. Compressed spring 928 applies force against latch 970 and latch-keeper piston 972. The large diameter portion of latch-keeper piston's piston is shown at latch piston 973. At the end of housing 904 distal from transducer 906, a threaded piston barrel 923 is threadably inserted into housing 904, circumferentially surrounding the rod portion of latch-keeper piston 972, this rod portion referred to as latch rod 976. Threaded piston barrel 923 contains a smaller diameter hole than its barrel portion's diameter, with this smaller diameter hole located at the end of housing 904 distal from transducer 906, said hole referred to as end hole 924, bored at the axial center of threaded piston barrel 923. A side hole(s) 922 in housing 904 is bored transverse to latch piston 973. In this first position as shown in FIG. 10A, the latch piston 973 seals side hole(s) 922, preventing external pressurized flow from entering latch piston 973 or housing 904.

A rod axial bore 919 extends through latch rod 976 to latch piston 973. A piston transverse bore 921 intersects rod axial bore 919, with piston transverse bore radially exiting one side of latch piston 973. In this first position, external pressurized fluid is sealed off by a portion of latch piston 973 positioned so that its circumferential face blocks side hole(s) 922.

Upon receiving the correct pressure ratios and applying the process described above in this disclosure, the computer 910 signals high-voltage capacitor 911 to discharge current through electrical wires 915 that connect to explosive push device 907.

FIG. 10B shows a half section view of actuator 900 following actuation of explosive push device 907, whose push device piston 975 has exerted force against latch 971 has unlatched keeper 977 of the latch-keeper piston. The unlatching action frees compressed spring 928, whose stored energy now exerts force against latch-keeper piston 972. Compressed spring 928 latch piston 973 toward end hole 924. In the advanced, second position of FIG. 10B, the latch piston 973 exposes piston transverse bore 921 to side hole 922, establishing fluid connectivity. External pressurized flow can now enter through side hole 922 and pass through piston transverse bore 921, rod axial bore 919, and exit through end hole 924. The end hole 924 connects to a separate actuable downhole device, such as a hydraulic packer, anchor, or similar downhole tool (not shown). Depending on programming, based on use of the process described above in this disclosure, the computer 910 can repeat the detonation of explosive push devices 907 multiple sequential times upon repeated receipt of the correct pressure ratios in subsequent instances. Furthermore, a plurality of explosive push devices 907 may be employed to actuate multiple connected components (not shown).

Another embodiment utilizes electrical actuation of dielectrically actuated polymers ("DEAF"), known in the art and produced by companies such as Danfoss, to move a piston in a separate assembly. This embodiment, DEAF actuator 1000, has a tubular housing 1004, a transducer 1006 located at one end of housing 1004, with the transducer in communication with a computer 1010, and a capacitor 1008 situated between the transducer 1006 and computer 1010 and used for powering the computer 1010. Housing 1004 is made of a material capable of resisting burst or crush pressure. High-voltage capacitor 1011 is located adjacent to the computer 1010 in the distal portion of housing 1004 from transducer 1006. A sealing member 1081 inside housing 1004 seals capacitor 1008, computer 1010, high-voltage capacitor 1011 from external pressure. The high-voltage capacitor connects to a stack of dielectrically actuated polymers, DEAP stack 1007, with electrical wires. The DEAP stack can be located inside or near to housing 1004, or can be placed in a disparate location in a wellbore for remote actuation. The DEAP stack changes form when electricity is applied to it, arching upward. This change in form exerts significant force as it occurs, and is capable of moving a hydraulic piston under significant load or pressure. The DEAP stack is composed of a plurality of DEAP membranes, which may be stacked in the nature of Belleville springs with additional layers of DEAP membranes providing additive force, with each deforming to the same shape concurrently with others. The DEAP actuator 1000 functions similarly as other embodiments in this disclosure, with pressure ratios being received by transducer 1006 and analyzed by computer 1010 using the process described above. The computer 1010 signals the high-voltage capacitor to send current to the DEAP stack which deforms and exerts force against a piston, with the piston being part of a downhole tool such as a wellbore anchor or packer (not shown).

Figure 11A:
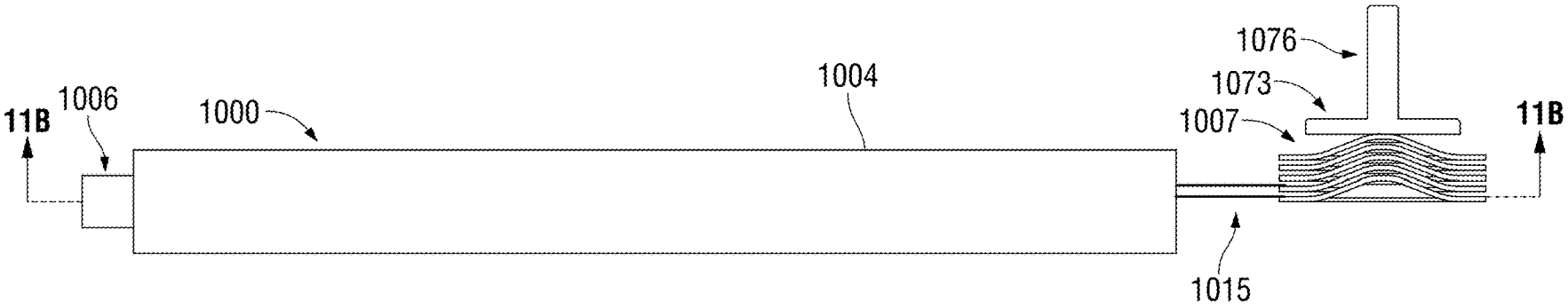
FIGS. 11A and 11B show section views a DEAP actuator according to the teachings of the present disclosure.
Figure 11B:
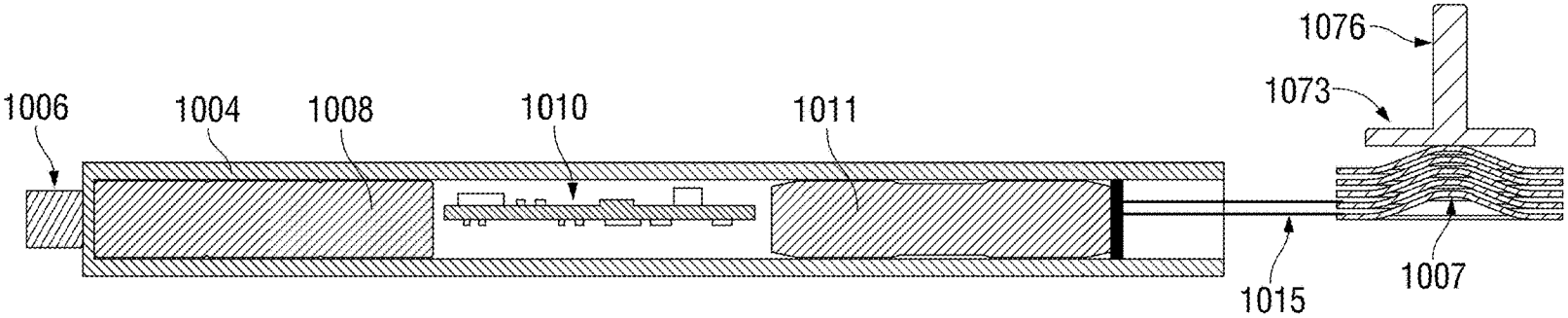

FIGS. 11A and 11B show section views a DEAP actuator according to the teachings of the present disclosure. FIG. 11A depicts an isometric view of DEAP actuator 1000, showing the DEAP stack 1007 from an overhead isometric view, with electrical wires 1015 leading from housing 1004 to connect with DEAP stack 1007. FIG. 11B depicts a section view 11B-11B of DEAP actuator 1000, with a stack of dielectrically actuated polymers, DEAP stack 1007, being in an actuated position and the individual membrane layers arching upward in the middle, each adjacent to the next with one on top of another. An unactuated position (not shown), would depict the membrane layers in DEAP stack 1007 as lying flat, each adjacent to the next with one on top of another. DEAP actuator 1000 further includes a tubular housing 1004 made of a material capable of resisting burst or crush pressure, a transducer 1006 located at one end of housing 1004, a capacitor 1008, a computer 1010, and a high-voltage capacitor 1011. High-voltage capacitor 1011 is located adjacent to the computer 1010 in the distal portion of housing 1004 from transducer 1006. A sealing member 1081 inside housing 1004 seals capacitor 1008, computer 1010, and high-voltage capacitor 1011 from external pressure. Through sealing member 1081, the high-voltage capacitor 1011 connects to DEAP stack 1007 with electrical wires 1015. The DEAP stack 1007 is shown proximal to housing 1004 in FIG. 11A and FIG. 11B. DEAP stack 1007 may be located, alternatively, a long distance from housing 1004 and the actuating power source, high-voltage capacitor 1011. Further alternatively, a small version of DEAP stack 1007 could be placed inside housing 1004 and with a piston and barrel (not shown) inline inside housing 1004. DEAP stack 1007 has its layers of membranes electrically connected so as to receive current concurrently and deform into another shape concurrently. Shown atop DEAP stack 1007 is piston 1073 with piston rod 1076. Piston 1073, along with DEAP stack 1007, can be placed in a cylinder or barrel housing of a separate downhole device such as a wellbore anchor or packer (not shown), well known in the art.

Upon receiving the correct pressure ratios and applying the process described above in this disclosure, the computer 1010 signals high-voltage capacitor 1011 to discharge current through electrical wires 1015, supplying that current to DEAP stack 1007.

FIG. 11B further shows section view 11B-11B of DEAP actuator 1000 in an actuated position, with the computer 1010 having analyzed the proper pressure ratios by applying the algorithm described in this disclosure and having signaled high-voltage capacitor 1011 to discharge, which has supplied current over electrical wires 1015 to actuate the DEAP stack 1007. The membrane layers of DEAP stack 1007 have changed form upon receiving current, and are shown arched upward. The stacking of membrane layers adds force, producing a similar result to stacking Belleville springs in compression. However, the DEAP membranes begin in a completely flat form (not shown), and with electrical actuation, deform, or change shape, and in doing so exert significant force. Piston 1073 can be advanced with force sufficient to set a downhole anchor or packer (not shown) with the force applied from DEAP stack 1007.

In summary, therefore, the present disclosure provides a triggering mechanism for oilfield wellbore downhole equipment. The presently disclosed triggering mechanism includes a housing for inserting downhole in an oilfield wellbore and associating with a downhole tool in a predetermined and desired position within the oilfield wellbore. The housing further associates downhole with a computer processor, a clock, at least one sensor circuit, and an electrical power source.

The computer processor includes computer processing circuitry for processing executable instructions associated with a plurality of physical parameters within the oilfield wellbore. The computer processor further includes at least one computer memory circuit including a computer readable memory circuit for storing the executable instructions and data associated with the plurality of physical parameters. The clock provides timing data to the computer processor. The at least one sensor circuit senses the plurality of physical parameters within the oilfield wellbore and generates and communicates the data associated with the plurality of physical parameters. The plurality of physical parameters include at least a pressure parameter associated with the pressure within the oilfield wellbore downhole environment. The electrical power source includes circuitry for powering the computer processor downhole within the oilfield wellbore.

A valve control circuit receives a plurality of valve control commands from the computer processor for controlling a valve, wherein the valve control commands control a valve associated with a flow path flowing a control fluid. A valve operating in response to the valve control commands controls flow of the control fluid from the flow path to an associated hydromechanical device within the oilfield wellbore. The hydromechanical device operates in association with the downhole tool within the oilfield wellbore.

Here, the valve control commands derive from real-time sampling of the downhole physical parameters. In response to the real-time sampling of the downhole physical parameters, the computer processor generates a plurality of ratio-based derivative values relating to physical parameter differences over a predetermined time span within the downhole wellbore environment. In response to the plurality of ratio-based derivative values relating to the physical parameter differences the triggering mechanism generates triggering commands to the valve for flowing the control fluid to the associated hydromechanical device. The triggering commands actuate the associated hydromechanical device from a first condition or status to a second condition or status.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein but is to be accorded the widest scope consistent with the principles and novel features disclosed herein. It is contemplated that additional embodiments are within the spirit and true scope of the disclosed subject matter.

What is claimed is:

1. A triggering mechanism for oilfield wellbore down hole equipment, comprising;

a housing for inserting downhole in an oilfield wellbore and associating with a downhole tool in a predetermined and desired position within said oilfield wellbore;

said housing further for associating there within a computer processor, a clock, at least one sensor circuit, and an electrical power source;

said computer processor comprising computer processing circuitry for processing executable instructions associated with a plurality of physical parameters within said oilfield wellbore, said computer processor further comprising at least one computer memory circuit comprising a computer readable memory circuit for storing said executable instructions and data associated with said plurality of physical parameters;

said clock comprising circuitry for providing timing data to said computer processor;

said at least one sensor circuit for sensing said plurality of physical parameters within said oilfield wellbore and generating and communicating said data associated with said plurality of physical parameters, said plurality of physical parameters comprising at least a pressure parameter associated with the pressure within said oilfield wellbore downhole environment; and said electrical power source comprising circuitry for powering said computer processor downhole within said oilfield wellbore;

a valve control circuit for receiving a plurality of valve control commands from said computer processor for controlling a valve, wherein said valve control commands control a valve associated with a flow path flowing a control fluid;

a valve operating in response to said valve control commands and in response thereto controlling flow of said control fluid from said flow path to an associated hydromechanical device within said oilfield wellbore, said hydromechanical device operating in association with said downhole tool within said oilfield wellbore;

wherein said valve control commands derive from real-time sampling of said downhole physical parameters; and further wherein, in response to said real-time sampling of said downhole physical parameters said computer processor generates a plurality of ratio-based derivative values relating to physical parameter differences over a predetermined time span within said downhole wellbore environment; and in response to said plurality of ratio-based derivative values relating to said physical parameter differences generating triggering commands to said valve for flowing said control fluid to said associated hydromechanical device for actuating said associated hydromechanical device from a first condition or status to a second condition or status.

2. The downhole electronic triggering and actuation mechanism of claim 1, further comprising executable instructions executing on said computer processor whereby said plurality of ratio-based derivative values provide for only triggering said actuator after said plurality of ratio-based derivative values are analyzed and confirmed to match preprogrammed parameters.

3. The downhole electronic triggering and actuation mechanism of claim 1, further comprising executable instructions executing on said computer processor whereby said plurality of ratio-based derivative values prevent triggering of said valve unexpectedly or undesiredly in response to spikes in wellbore pressures.

4. The downhole electronic triggering and actuation mechanism of claim 1, wherein said electrical power source further comprises a capacitor powered circuit unconnected with equipment or circuitry outside the wellbore.

5. The downhole electronic triggering and actuation mechanism of claim 1, further comprising executable instructions executing on said computer processor whereby said plurality of ratio-based derivative values prevent triggering said valve control circuitry in response to pressure pulses deriving from use of measurement while drilling (MWD) equipment.

6. The downhole electronic triggering and actuation mechanism of claim 1, further comprising executable instructions executing on said computer processor whereby said plurality of ratio-based derivative values prevent triggering said valve control circuitry in response to gradual changes in wellbore pressures and, instead, respond only to a predetermined set of pressure ratios within the wellbore.

7. The downhole electronic triggering and actuation mechanism of claim 1, further comprising executable instructions executing on said computer processor whereby said plurality of ratio-based derivative values provide data for use by said computer processor for performing multiple ratio-based pressure derivative analyses deriving from pressures and time spans for use in conditional logic circuitry for confirming the presence of a valve actuation triggering event.

8. A method for operating downhole electronic triggering and actuation mechanism for oilfield wellbore downhole equipment, comprising the steps of;

providing a housing for inserting downhole in an oilfield wellbore and associating with a downhole tool in a predetermined and desired position within said oilfield wellbore;

further associating with said housing a computer processor, a clock, at least one sensor circuit, and an electrical power source;

providing, in association with said computer processor, processing circuitry for processing executable instructions associated with a plurality of physical parameters within said oilfield wellbore, said computer processor further comprising at least one computer memory circuit comprising a computer readable memory circuit for storing said executable instructions and data associated with said plurality of physical parameters;

providing, from said clock, timing data to said computer processor;

sensing said plurality of physical parameters within said oilfield wellbore and generating and communicating said data associated with said plurality of physical parameters using said at least one sensor circuit, said plurality of physical parameters comprising at least a pressure parameter associated with the pressure within said oilfield wellbore downhole environment; and powering said computer processor downhole within said oilfield wellbore using said electrical power source;

receiving a plurality of valve control commands from said computer processor for controlling a valve using a valve control circuit, wherein said valve control commands control a valve associated with a flow path flowing a control fluid;

operating a valve in response to said valve control commands and in response thereto controlling flow of said control fluid from said flow path to an associated hydromechanical device within said oilfield wellbore, said hydromechanical device operating in association with said downhole tool within said oilfield wellbore;

deriving said valve control commands from real-time sampling of said downhole physical parameters; and further generating a plurality of ratio-based derivative values relating to physical parameter differences over a predetermined time span within said downhole wellbore environment in response to said real-time sampling of said downhole physical parameters said computer processor; and generating triggering commands to said valve for flowing said control fluid to said associated hydromechanical device for actuating said associated hydromechanical device from a first condition or status to a second condition or status in response to said plurality of ratio-based derivative values relating to said physical parameter differences.

9. The method of claim 8, further comprising the step of executing executable instructions on said computer processor whereby said plurality of ratio-based derivative values provide for only triggering said actuator after said plurality of ratio-based derivative values are analyzed and confirmed to match preprogrammed parameters.

10. The method of claim 8, further comprising the step of executing executable instructions on said computer processor whereby said plurality of ratio-based derivative values prevent triggering of said valve unexpectedly or undesiredly in response to spikes in wellbore pressures.

11. The method of claim 8, further comprising the step of providing said electrical power source further comprises a capacitor powered circuit unconnected with equipment or circuitry outside the wellbore.

12. The method of claim 8, further comprising the step of executing said executable instructions on said computer processor whereby said plurality of ratio-based derivative values prevent triggering said valve control circuitry in response to pressure pulses deriving from use of measurement while drilling (MWD) equipment.

13. The method of claim 8, further comprising the step of executing said executable instructions on said computer processor whereby said plurality of ratio-based derivative values prevent triggering said valve control circuitry in response to gradual changes in wellbore pressures and, instead, respond only to a predetermined set of pressure ratios within the wellbore.

14. The method of claim 8, further comprising the step of executing said executable instructions on said computer processor whereby said plurality of ratio-based derivative values provide data for use by said computer processor for performing multiple ratio-based pressure derivative analyses deriving from pressures and time spans for use in conditional logic circuitry for confirming the presence of a valve actuation triggering event.

15. A method for manufacturing a downhole electronic triggering and actuation mechanism, comprising the steps of:

making a housing for inserting downhole in an oilfield wellbore and associating with a downhole tool in a predetermined and desired position within said oilfield wellbore;

installing in association with said housing a computer processor, a clock, at least one sensor circuit, and an electrical power source;

said computer processor comprising computer processing circuitry for processing executable instructions associated with a plurality of physical parameters within said oilfield wellbore, said computer processor further comprising at least one computer memory circuit comprising a computer readable memory circuit for storing said executable instructions and data associated with said plurality of physical parameters;

said clock comprising circuitry for providing timing data to said computer processor;

said at least one sensor circuit for sensing said plurality of physical parameters within said oilfield wellbore and generating and communicating said data associated with said plurality of physical parameters, said plurality of physical parameters comprising at least a pressure parameter associated with the pressure within said oilfield wellbore downhole environment; and said electrical power source comprising circuitry for powering said computer processor downhole within said oilfield wellbore;

making a valve control circuit for receiving a plurality of valve control commands from said computer processor for controlling a valve, wherein said valve control commands control a valve associated with a flow path flowing a control fluid;

making a valve operating in response to said valve control commands and in response thereto controlling flow of said control fluid from said flow path to an associated hydromechanical device within said oilfield wellbore, said hydromechanical device operating in association with said downhole tool within said oilfield wellbore;

wherein said valve control commands derive from real-time sampling of said downhole physical parameters; and further wherein, in response to said real-time sampling of said downhole physical parameters said computer processor generates a plurality of ratio-based derivative values relating to physical parameter differences over a predetermined time span within said downhole wellbore environment; and programming said computer processor such that in response to said plurality of ratio-based derivative values relating to said physical parameter differences said trigger mechanism generates triggering commands to said valve for flowing said control fluid to said associated hydromechanical device for actuating said associated hydromechanical device from a first condition or status to a second condition or status.

16. The downhole electronic triggering and actuation mechanism manufacturing method of claim 15, further comprising the step of making executable instructions for executing on said computer processor whereby said plurality of ratio-based derivative values provide for only triggering said actuator after said plurality of ratio-based derivative values are analyzed and confirmed to match preprogrammed parameters.

17. The downhole electronic triggering and actuation mechanism manufacturing method of claim 15, further comprising the step of making executable instructions executing on said computer processor whereby said plurality of ratio-based derivative values prevent triggering of said valve unexpectedly or undesiredly in response to spikes in wellbore pressures.

18. The downhole electronic triggering and actuation mechanism manufacturing method of claim 15, further comprising the step of making said electrical power source further comprises a capacitor powered circuit unconnected with topside equipment or circuitry.

19. The downhole electronic triggering and actuation mechanism manufacturing method of claim 15, further comprising the step of making executable instructions for executing on said computer processor whereby said plurality of ratio-based derivative values prevent triggering said valve control circuitry in response to pressure pulses deriving from use of measurement while drilling (MWD) equipment.

20. The downhole electronic triggering and actuation mechanism manufacturing method of claim 15, further comprising the step of making executable instructions for executing on said computer processor whereby said plurality of ratio-based derivative values prevent triggering said valve control circuitry in response to gradual changes in wellbore pressures and, instead, respond only to a predetermined set of pressure ratios within the wellbore.

* * * * *